US008032290B2

(12) United States Patent
Asano et al.

(10) Patent No.: US 8,032,290 B2
(45) Date of Patent: Oct. 4, 2011

(54) CONTROL DEVICE FOR AN INTERNAL COMBUSTION ENGINE

(75) Inventors: Seiji Asano, Hitachinaka (JP); Masanobu Ohsaki, Maebashi (JP); Takayuki Obu, Isesaki (JP)

(73) Assignee: Hitachi, Ltd., Tokyo (JP)

( * ) Notice: Subject to any disclaimer, the term of this patent is extended or adjusted under 35 U.S.C. 154(b) by 338 days.

(21) Appl. No.: 12/472,087

(22) Filed: May 26, 2009

(65) Prior Publication Data

US 2010/0012100 A1 Jan. 21, 2010

(30) Foreign Application Priority Data

Jul. 18, 2008 (JP) ..... 2008-187687

(51) Int. Cl.
*F02M 33/02* (2006.01)

(52) U.S. Cl. ..... 701/103; 123/520

(58) Field of Classification Search ..... 701/103–107, 701/110; 123/519–520

See application file for complete search history.

(56) References Cited

U.S. PATENT DOCUMENTS 6,823,851 B2 * 11/2004 Amano et al. ..... 123/520

FOREIGN PATENT DOCUMENTS

JP 10-14114 A 5/1998

* cited by examiner

*Primary Examiner* — Hai Huynh
(74) *Attorney, Agent, or Firm* — Crowell & Moring LLP

(57) ABSTRACT

A control device for an internal combustion engine can quickly control, regardless of variation of the quantity of evaporative fuel gas adsorbed in a canister of the engine, the air-fuel ratio to a target value by performing air-fuel ratio feedback compensation control so as not to cause the emission performance of the engine to deteriorate. For the first canister purge performed after the engine is started up, a purge valve is driven for a prescribed period at a prescribed purge flow rate. During the period, the quantity of purged fuel is calculated using an air-fuel ratio feedback factor. Based on the fuel quantity thus calculated, an adsorption quantity estimation section estimates the quantity of evaporative fuel gas adsorbed in the canister. At the same time, a fuel evaporation quantity calculation section calculates the quantity of fuel evaporating from a fuel tank according to the condition of the engine and vehicle, and the quantity of fuel in the canister is estimated based on the balance between the quantities of fuel charged to and purged from the canister.

9 Claims, 24 Drawing Sheets

CONTROL DEVICE FOR AN INTERNAL COMBUSTION ENGINE

FIELD OF THE INVENTION

The present invention relates to a control device for an internal combustion engine, for example, one which performs air-fuel ratio correction associated with purging of evaporative fuel gas adsorbed by an evaporative fuel gas adsorption unit.

BACKGROUND OF THE INVENTION

Vehicles, for example, automobiles driven by an internal combustion engine (hereinafter also referred to simply as an "engine") have a canister such as a charcoal canister as means of adsorbing and storing evaporative fuel gas generated in a fuel tank so as to prevent air pollution. The evaporative fuel gas adsorbed by the canister is purged to an intake passage of the engine at a flow rate controlled by a purge control valve (canister purge control valve). This kind of control is referred to as "canister purge control."

Existing types of air-fuel ratio control devices for engines in which evaporative fuel gas purge control is performed as described above include one in which: the quantity of evaporative fuel gas purged from a canister is estimated based on the intake pipe negative pressure, engine speed, and purge control valve opening; the air-fuel ratio variation caused by purging of evaporative fuel gas is estimated; the quantity of fuel supply is corrected, while evaporative fuel gas is purged, based on the estimated value of air-fuel ratio variation; and feedback control is performed by applying a correction factor determined based on the air-fuel ratio detected by an air-fuel ratio sensor (see JP-A No. H10-141114, for example).

SUMMARY OF THE INVENTION

The quantity of evaporative fuel gas adsorbed in a canister (referred to as an "adsorption quantity") mounted in a vehicle varies according to the condition of the vehicle, including the condition of the engine of the vehicle. When the evaporative fuel gas adsorption quantity in the canister changes, the concentration of evaporative fuel gas purged from the canister changes. This makes the degree of change in air-fuel ratio caused by purging of evaporative fuel gas variable even with the opening of the purge control valve unchanged.

When the degree of change in air-fuel ratio caused by purging of evaporative fuel gas does not vary much, the air-fuel ratio can be controlled to a target value by air-fuel ratio feedback compensation without difficulty. When the degree of change in air-fuel ratio largely varies, however, the air-fuel ratio cannot be smoothly controlled to a target value, so that the emission performance of the engine deteriorates.

The present invention has been made in view of the above problem and it is an object of the invention to provide a control device for an internal combustion engine which can quickly control, regardless of variation of the quantity of evaporative fuel gas adsorbed in a canister, the air-fuel ratio to a target value by performing air-fuel ratio feedback compensation control so as not to cause the emission performance of the engine to deteriorate.

To achieve the above object, the control device for an internal combustion engine according to the present invention is provided with an evaporative fuel gas adsorption unit which adsorbs evaporative fuel gas from a fuel tank, an evaporative fuel gas purging unit which is internally provided with an opening-adjustable purge control valve and which purges evaporative fuel gas adsorbed by the evaporative fuel gas adsorption unit into an intake passage of the internal combustion engine, and a fuel correction unit which feedback controls, based on an air-fuel ratio detected by an air-fuel ratio detection unit, an air-fuel ratio of an air-fuel mixture to be fed to the internal combustion engine to a prescribed value. The control device comprises: a purge control valve opening control unit which performs control to open the purge control valve under a prescribed condition; a purge quantity calculation unit which, with the purge control valve open under the prescribed condition, calculates a quantity of purged evaporative fuel gas based on a fuel correction value determined by the fuel correction unit engaged in fuel correction calculation for realizing a prescribed air-fuel ratio; an adsorption quantity estimation unit which determines, based on a quantity of purged evaporative fuel gas calculated by the purge quantity calculation unit, a quantity of evaporative fuel gas adsorbed by the evaporative fuel gas adsorption unit; an adsorption quantity change calculation unit which changes, according to a condition of the internal combustion engine and vehicle, a quantity of evaporative fuel gas determined by the adsorption quantity estimation unit; an adsorption quantity correction unit which corrects, according to a condition of the fuel correction unit, a change value calculated by the adsorption quantity change calculation unit; and a fuel correction value calculation unit which calculates a fuel correction value based on an adsorption quantity change calculated by the adsorption quantity change calculation unit.

Preferably, in the control device for an internal combustion engine according to the invention, the fuel correction unit comprises a target air-fuel ratio setting unit which determines a target air-fuel ratio according to a condition of the internal combustion engine, and an air-fuel ratio feedback control factor calculation unit which calculates an air-fuel ratio feedback control factor for PID control based on a difference between an air-fuel ratio detected by the air-fuel ratio detection unit and a target air-fuel ratio set by the target air-fuel ratio setting unit; and changes, under the prescribed condition, a gain of PID control while a quantity of purged evaporative fuel gas is calculated based on a fuel correction value determined thereby.

Preferably, in the control device for an internal combustion engine according to the invention, the fuel correction unit comprises a target air-fuel ratio setting unit which determines a target air-fuel ratio according to a condition of the internal combustion engine, an air-fuel ratio feedback control factor calculation unit which calculates an air-fuel ratio feedback control factor for PID control based on a difference between an air-fuel ratio detected by the air-fuel ratio detection unit and a target air-fuel ratio set by the target air-fuel ratio setting unit, a response delay setting unit which sets a response delay of the air-fuel ratio detection unit, and an air-fuel ratio advance correction value calculation section which calculates, based on a response delay set by the response delay setting unit, a true air-fuel ratio from an air-fuel ratio value detected by the air-fuel ratio detection unit and which determines a fuel correction value based on the calculated true air-furl ratio; and performs fuel correction using a fuel correction value determined by the PID control and the air-fuel ratio advance correction value calculation section.

Preferably, in the control device for an internal combustion engine according to the invention, the purge control valve opening control unit comprises a purge quantity calculation unit which sets a prescribed evaporative fuel gas flow rate under the prescribed condition and a differential pressure compensation value calculation unit which calculates a differential pressure compensation value from pressures of evaporative fuel gas before and after passing the purge control valve; and corrects an opening of the purge control valve according to the differential pressure compensation value so as to achieve the prescribed evaporative fuel gas flow rate.

Preferably, in the control device for an internal combustion engine according to the invention, the adsorption quantity change calculation unit comprises a time-constant determination unit for determining a time-constant which decreases according to the evaporative fuel gas flow rate; and determines, based on the time-constant determined by the time-constant determination unit, a quantity of evaporative fuel gas evaporating from the fuel tank per unit time and performing calculation to change an adsorption quantity.

Preferably, in the control device for an internal combustion engine according to the invention, the adsorption quantity change calculation unit determines a quantity of evaporative fuel gas evaporating from the fuel tank per unit time according to an intake air temperature, a vehicle speed, idle condition, and accessory load condition; and performs calculation to change an adsorption quantity.

Preferably, in the control device for an internal combustion engine according to the invention, the adsorption quantity change calculation unit holds an adsorption quantity change value representing a change in a quantity of adsorbed evaporative fuel gas at a time when the purge control valve is closed; adds, to the change value thus held, a quantity of evaporative fuel gas coming from the fuel tank according to a condition of the internal combustion engine and vehicle; and, when the purge control valve is opened again, sets a fuel correction value based on an adsorption quantity change, an initial value of which is set to be equal to a value obtained as a result of the addition.

Preferably, in the control device for an internal combustion engine according to the invention, the adsorption quantity estimation unit comprises a unit which determines a state of a variable of the fuel correction unit for realizing a desired air-fuel ratio from an air-fuel ratio detected, in a state with the purge control valve open, by the air-fuel ratio detection unit and a unit for determining a certain interval time; and corrects, every time the interval time elapses, a quantity of adsorbed evaporative fuel gas according to the state of the variable.

Preferably, in the control device for an internal combustion engine according to the invention, the state of a variable of the fuel correction unit for realizing a desired air-fuel ratio from an air-fuel ratio detected by the air-fuel ratio detection unit is an average I-portion value of the air-fuel ratio PID control.

In the control device for an internal combustion engine according to the present invention, the quantity of evaporative fuel gas adsorbed in a canister of the engine is detected, and the air-fuel ratio is corrected according to the detected quantity of adsorbed evaporative fuel gas. This makes it possible to suppress, regardless of variation of the quantity of evaporative fuel gas adsorbed in the canister of the engine, the variation of the air-fuel ratio when evaporative fuel gas is purged from the canister and allow the air-fuel ratio to be quickly controlled to a target value by air-fuel ratio feedback compensation control without causing emission performance deterioration. Furthermore, when the evaporative fuel gas adsorption quantity is estimated, the air-fuel ratio variation can be suppressed also by changing air-fuel ratio feedback gains or by correcting the air-fuel ratio in advance.

DETAILED DESCRIPTION OF THE PREFERRED EMBODIMENT

An embodiment of a control device for an internal combustion engine according to the present invention will be described with reference to drawings.

Figure 1:
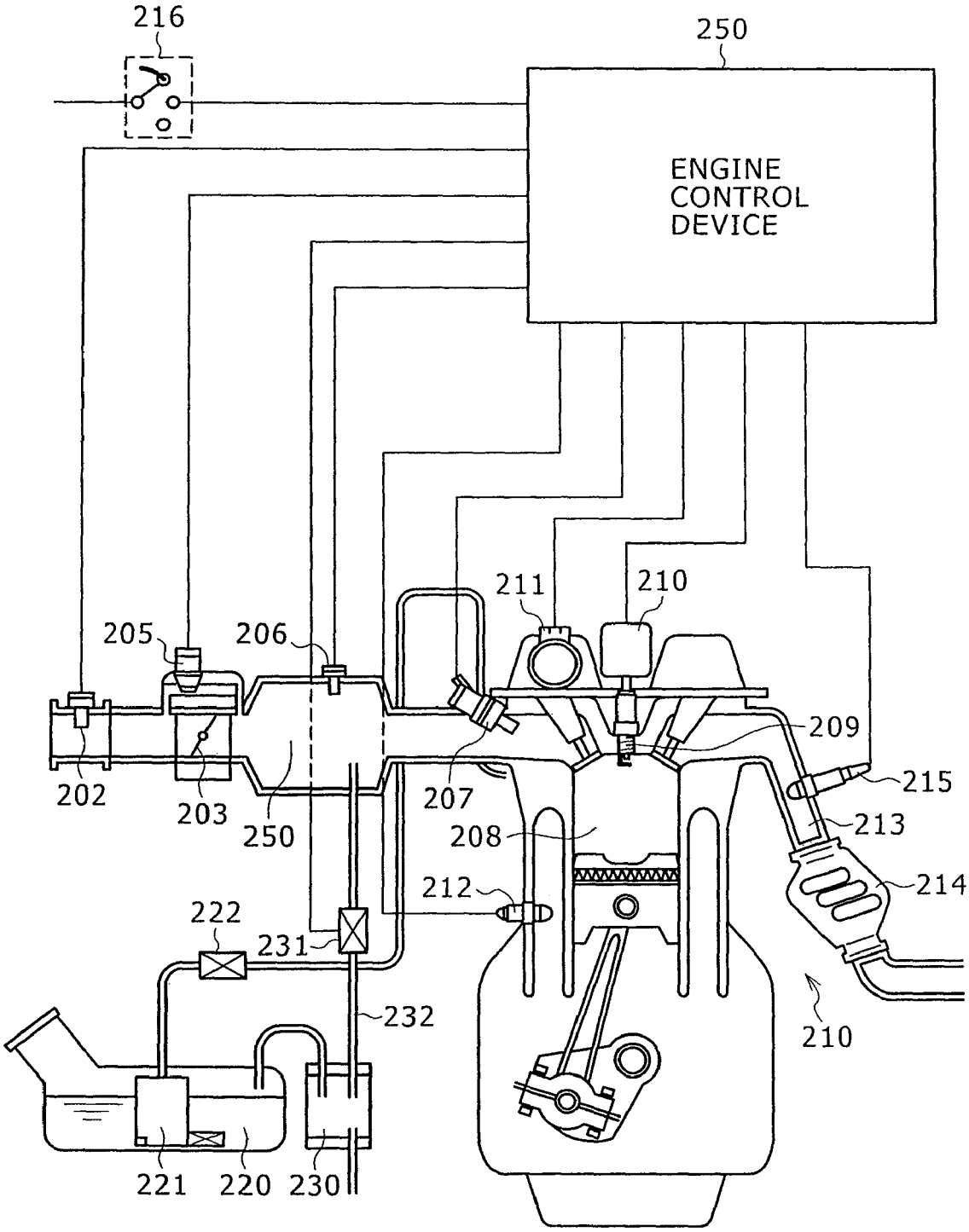
FIG. 1 is a diagram showing the configuration of an internal combustion engine for an automobile in which canister purge control is performed according to an embodiment of the present invention.
Figure 2:
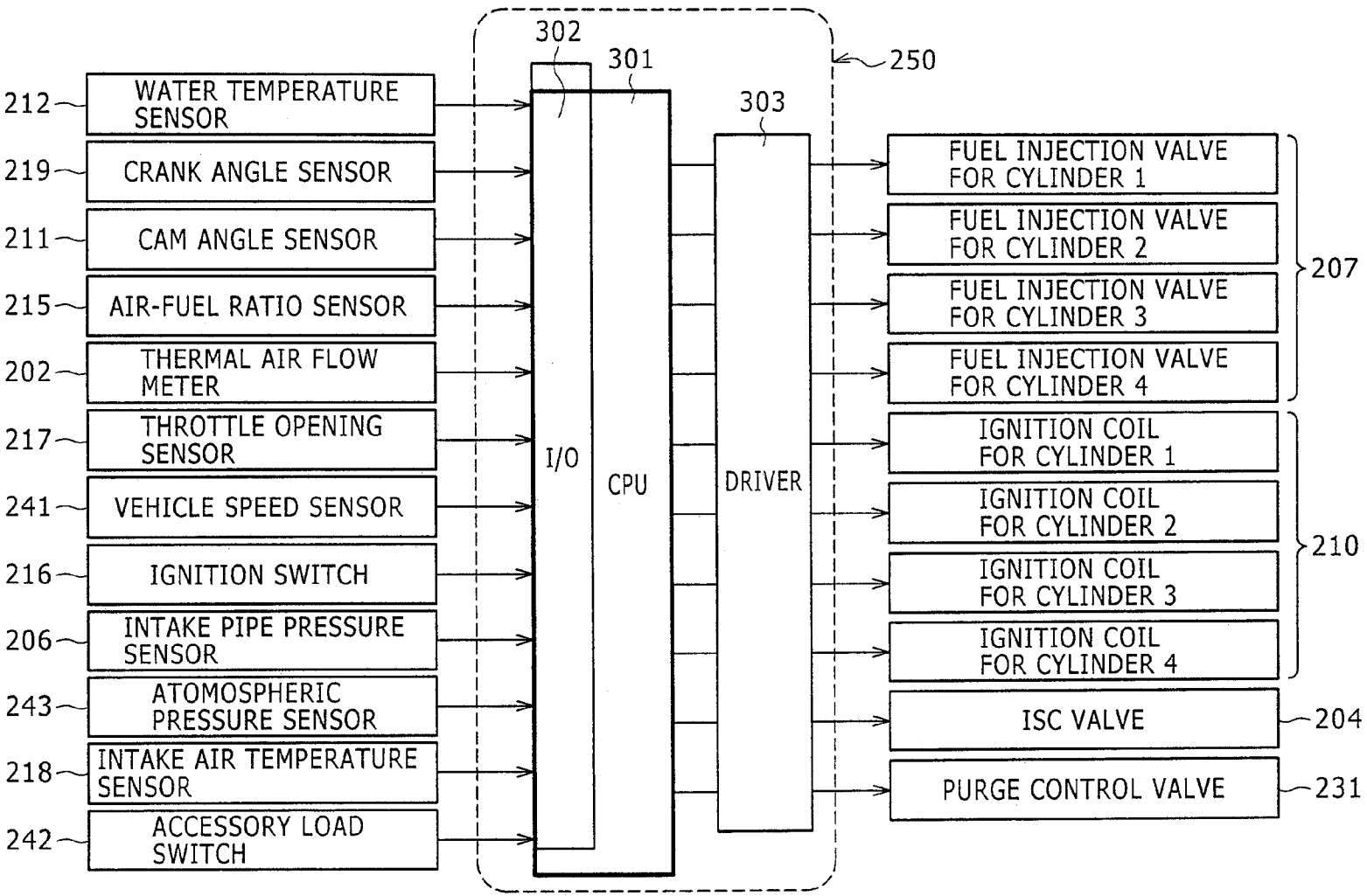
FIG. 2 is a diagram showing an engine control system in which canister purge control is performed according to the present embodiment.

FIG. 1 is a diagram showing the configuration of an embodiment of an internal combustion engine for an automobile in which canister purge control is performed according to the present invention.

Referring to FIG. 1, an engine 201 has, in an intake system thereof, a thermal air flow meter 202 for measuring an intake air flow rate, a throttle valve 203 for adjusting the flow rate of air taken in by the engine 201, an idle-speed control (ISC) valve 204 which controls the idle speed of the engine 201 by controlling the area of a flow passage connected, bypassing the throttle valve 203, to an intake pipe 205, an intake pipe pressure sensor 206 installed in the intake pipe 205 to detect the pressure therein, and a fuel injection valve 207 provided for each cylinder to inject fuel thereinto as required by the engine 201.

The engine 201 is equipped with an ignition plug 209 for igniting an air-fuel mixture injected into the combustion chamber of each cylinder 208 and an ignition coil (ignition module) 210 installed for each cylinder to provide ignition energy in response to an ignition signal from an engine control device 250.

A cam angle sensor 211 for detecting a cam angle and a water temperature sensor 212 for detecting the cooling water temperature are also provided in the engine 201.

A catalyst 214 is connected to an exhaust pipe 213. An air-fuel ratio sensor (LAF sensor) 215 which outputs a linear electrical signal proportional to the oxygen density in exhaust gas is disposed upstream of the catalyst 214 as seen along the flow of exhaust gas.

The engine 201 is, for example, a gasoline engine. Gasoline stored as fuel in a fuel tank 220 is pumped up by a fuel pump 221, then supplied, after being regulated by a pressure regulating means 222 to a predetermined fuel pressure, to each of the fuel injection valves 207.

The fuel tank 220 is connected with a canister 230 used as an evaporative fuel gas adsorption means which adsorbs and holds, for example, using charcoal, evaporative fuel gas generated in the fuel tank 220. The canister 230 is connected to the intake pipe 205 via a purge passage 232 which is provided at a partway portion thereof with a purge control valve 231, the opening of which is adjustable for quantitative flow rate control.

The engine 201 is started and stopped using an ignition switch 216 provided as a main switch. The air-fuel ratio control and other engine control operations such as fuel control, idle control, ignition timing control, and evaporative fuel gas purge control are governed by the engine control device 250.

In the present embodiment, the idle speed of the engine 201 is controlled by the idle speed control valve 204. When the throttle valve 203 is one whose opening can be controlled, for example, by a motor, then the throttle valve 203 can control the idle speed. In such a case, the idle speed control valve 204 is not required.

The engine control device 250 carries out electronic control using a microcomputer. The configuration of the engine control device 250 is shown in detail in FIG. 3. The engine control device 250 has a CPU 301 including an I/O section 302. The I/O section 302 converts electrical signals from sensors installed in the engine 201 into control signals for digital processing, then converts the control signals into actuator drive signals. The I/O section 302 is connected with the water temperature sensor 212, a crank angle sensor 219, the cam angle sensor 211, the air-fuel ratio sensor 215, the intake air quantity sensor (thermal air flow meter) 202, a throttle opening sensor 217, a vehicle speed sensor 241, the ignition switch 216, the intake pipe pressure sensor 206, an atmospheric pressure sensor 243, an intake air temperature sensor 218, and an accessory load switch (air conditioner switch) 242.

The CPU 301 is connected with a driver 303 for driving actuators of the fuel injection valves 207, the ignition coils 210, the idle speed control valve 204, and the purge control valve 231. The CPU 301 outputs drive signals to the actuators via the driver 303.

Figure 3:
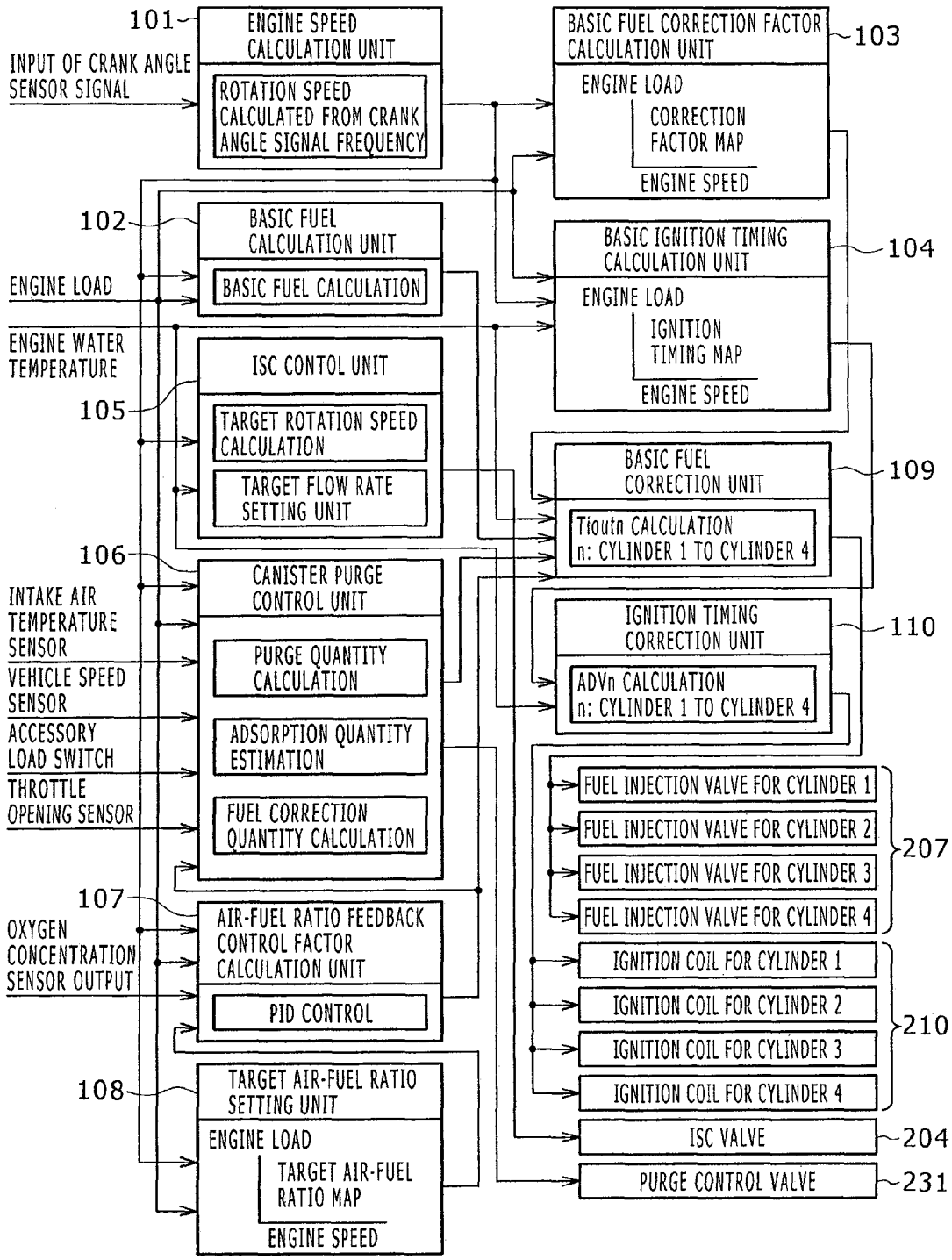
FIG. 3 is a block diagram showing an engine control device of the internal combustion engine for an automobile in which canister purge control is performed according to the present embodiment.

An example control block of the engine control device 250 according to the present embodiment will be described with reference to FIG. 3.

The engine control device 250 realizes, by executing a computer program, such software units as an engine speed calculation unit 101, a basic fuel calculation unit 102, a basic fuel correction factor calculation unit 103, a basic ignition timing calculation unit 104, an ISC control unit 105, a canister purge control unit 106, an air-fuel ratio feedback control factor calculation unit 107, a target air-fuel ratio setting unit 108, a basic fuel correction unit 109, and an ignition timing correction unit 110.

The engine speed calculation unit 101 calculates the number of rotations per unit time of the engine 201 by counting the number of electrical signals, mostly representing pulse signal changes, inputted per unit time from the crank angle sensor 219 set at a predetermined crank angle position of the engine 201 and arithmetically processing the count.

The basic fuel calculation unit 102 calculates a basic fuel quantity required by the engine 201 for each operating zone based on the engine speed calculated by the engine speed calculation unit 101 and either of the intake air flow rate measured by the thermal air flow meter 202 or the intake pipe pressure detected by the intake pipe pressure sensor 206. The intake air flow rate and intake pipe pressure are representative engine loads, so that they will be hereinafter referred to collectively as an engine load.

The basic fuel correction factor calculation unit 103 calculates a correction factor for correcting the basic fuel quantity for each operating zone of the engine 201 using a map of engine speed vs. engine load.

The basic ignition timing calculation unit 104 determines optimum ignition timing for each operating zone using a map of engine speed vs. engine load.

The ISC control unit 105 sets, based on the engine load and a water temperature signal from the water temperature sensor 212, a target idle speed of the engine 201 for maintaining the idle speed at a predetermined value and outputs an ISC valve signal for a target air flow rate to the ISC valve 203.

The ISC valve signal causes the ISC valve 203 to be driven to achieve the target air flow rate for idling. The target idle speed is achieved with the air flow rate thus controlled by the ISC valve 203.

The canister purge control unit 106 has signals inputted from the thermal air flow meter 202 or intake pipe pressure sensor 206, the throttle opening sensor 217, the vehicle speed sensor 241, the intake air temperature sensor 218, and the accessory load switch 242. It also has a signal indicating-an air-fuel ratio feedback control factor inputted from the air-fuel ratio feedback control factor calculation unit 107 being described later. The information provided by such signals includes, for example, intake air temperature, engine load, engine speed, vehicle speed, accessory load condition, idle condition determined based on the degree of throttle opening, and an air-fuel ratio feedback control factor. Based on such information, the canister purge control unit 106 calculates the quantity of evaporative fuel gas purged from the canister 230, estimates the quantity of evaporative fuel gas adsorbed in the canister 230, and calculates a fuel correction quantity to be applied when evaporative fuel gas is purged.

The canister purge control unit 106 outputs a signal to drive the purge control valve 231 so as to achieve the calculated quantity of evaporative fuel gas purged from the canister 230 as a target flow rate.

As a result, the opening of the purge control valve 231 is adjusted so as to achieve the target flow rate corresponding to the calculated quantity of purged evaporative fuel gas. This causes evaporative fuel gas to be purged at the target flow rate.

The air-fuel ratio feedback control factor calculation unit 107 calculates an air-fuel ratio feedback control factor based on the difference between the output of the air-fuel ratio sensor 215 and a target air-fuel ratio being described later.

The target air-fuel ratio setting unit 108 determines a target air-fuel ratio for the engine 201 using a map of engine speed vs. engine load.

The basic fuel correction unit 109 corrects the basic fuel quantity calculated by the basic fuel calculation unit 102. The correction is carried out using a correction factor calculated by the basic fuel correction factor calculation unit 103, an air-fuel ratio feedback control factor calculated by the air-fuel ratio feedback control factor calculation unit 107, a correction quantity dependent on the engine water temperature, and a fuel correction quantity calculated by the canister purge control unit 106 for application when evaporative fuel gas is purged. The basic fuel correction unit 109 then outputs a fuel injection signal specifying the corrected fuel quantity to be injected to the fuel injection valve 207 of each cylinder. This causes the fuel injection valve 207 of each cylinder to inject the corrected quantity of fuel into the cylinder.

The ignition timing correction unit 110 corrects the basic ignition timing determined by the basic ignition timing calculation unit 104 by applying a correction quantity dependent on the engine water temperature, and outputs a post-correction ignition timing signal to the ignition coil 210 of each cylinder.

This causes the ignition plug of each cylinder to discharge a spark at prescribed timing to ignite the air-fuel mixture injected into the cylinder 208.

Figure 4:
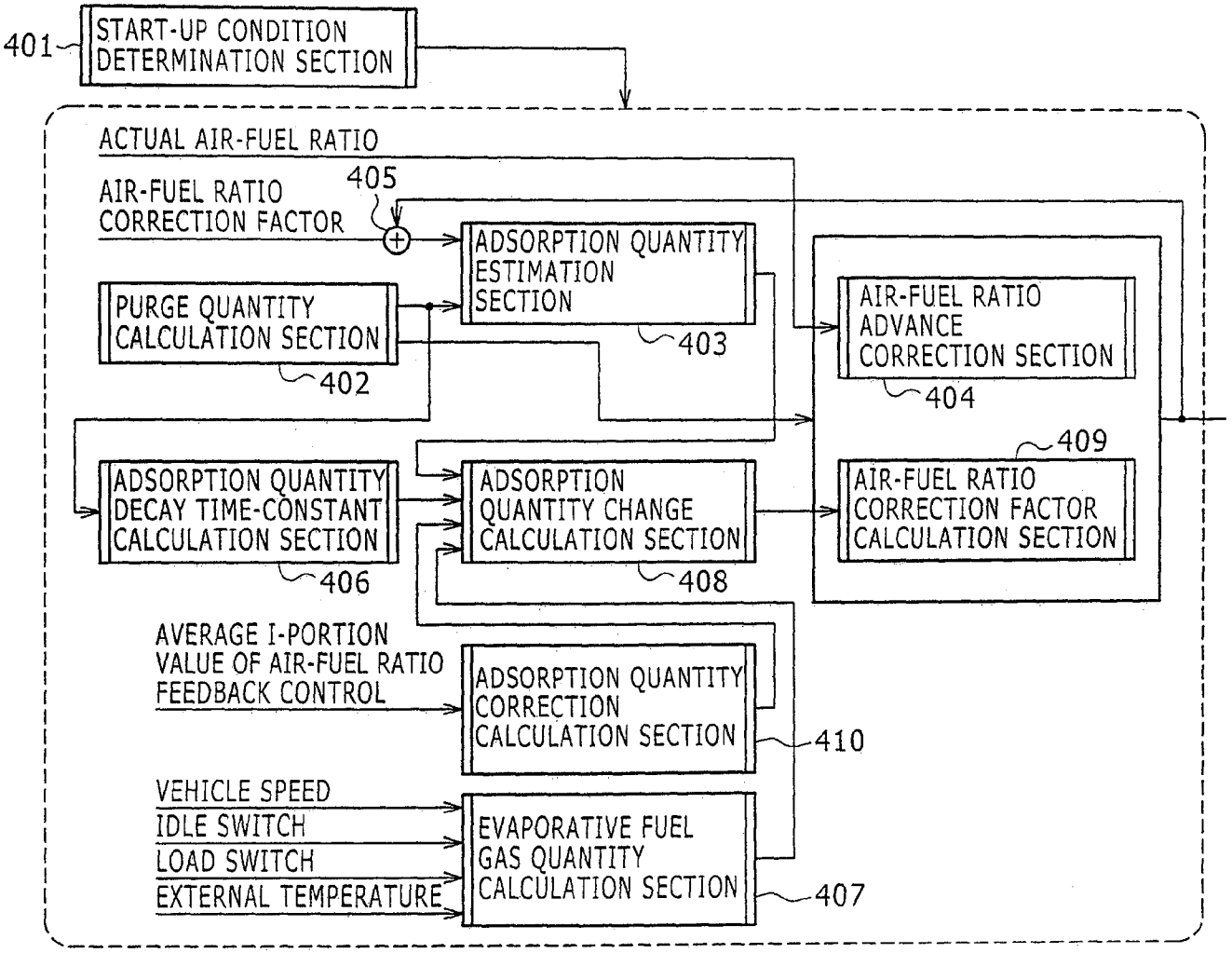
FIG. 4 is a block diagram of a canister purge control unit of the control device according to the present embodiment.

FIG. 4 is a block diagram of the entire canister purge control unit 106.

The canister purge control unit 106 includes a start-up condition determination section 401 which determines establishment of a start-up condition, a purge quantity calculation section 402 which calculates a target purge flow rate, an adsorption quantity estimation section 403 which estimates the quantity of evaporative fuel gas adsorbed in the canister 230, an air-fuel ratio advance correction section 404, an adsorption quantity decay time-constant calculation section 406, an evaporative fuel gas quantity calculation section 407, an adsorption quantity change calculation section 408, an air-fuel ratio correction factor calculation section 409, and an adsorption quantity correction calculation section 410.

The air-fuel ratio advance correction section 404 calculates an air-fuel ratio advance correction factor based on an actual air-fuel ratio measured by the air-fuel ratio sensor 215. The air-fuel ratio advance correction factor is added, by an adder 405, to an air-fuel ratio correction factor (i.e. an air-fuel ratio feedback control factor calculated by the air-fuel ratio feedback control factor calculation unit 107), and the sum is inputted to the adsorption quantity estimation section 403.

The adsorption quantity decay time-constant calculation section 406 calculates a time constant for decaying of the quantity of evaporative fuel gas adsorbed in the canister 230 based on a purge flowrate calculated by the purge quantity calculation section 402.

The evaporative fuel gas quantity calculation section 407 calculates a quantity of evaporative fuel gas evaporating from the fuel tank 220 and being adsorbed by the canister 230 based on the vehicle speed, idle switch setting, accessory load switch setting, and external temperature.

The adsorption quantity change calculation section 408 calculates a change in the quantity of evaporative fuel gas adsorbed in the canister 230 based on an evaporative fuel gas adsorption quantity estimated by the adsorption quantity estimation section 403, an adsorption quantity decay time-constant calculated by the adsorption quantity decay time-constant calculation section 406, an evaporative fuel gas quantity calculated by the evaporative fuel gas quantity calculation section 407, and the adsorption quantity correction value calculated by an adsorption quantity correction calculation section 410 being described later.

The air-fuel ratio correction factor calculation section 409 calculates an air-fuel ratio correction factor based on a change, calculated by the adsorption quantity change calculation section 408, in the quantity of evaporative fuel gas adsorbed in the canister 230.

The adsorption quantity correction calculation section 410 calculates, based on an average value of the I portion of air-fuel ratio feedback control, a correction value for correcting the quantity of evaporative fuel gas adsorbed in the canister 230 calculated by the adsorption quantity change calculation section 408.

Figure 5:
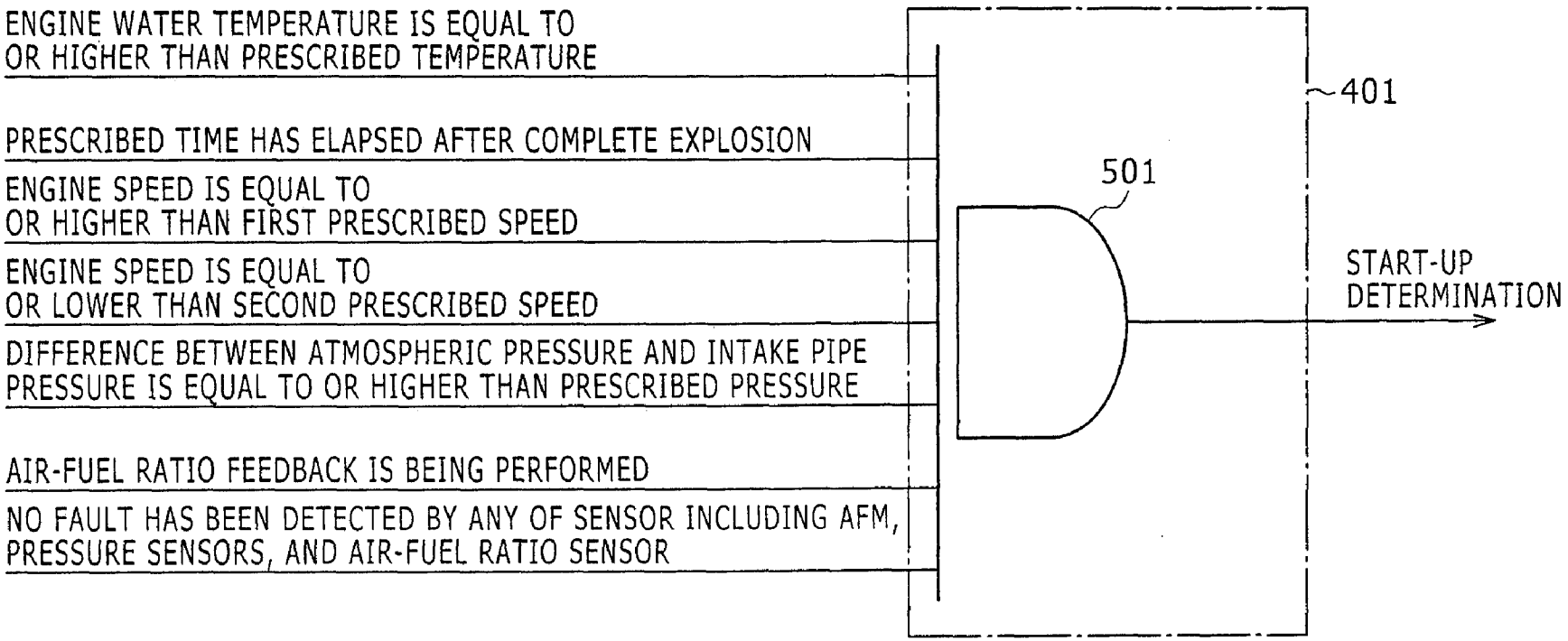
FIG. 5 is a block diagram showing example details of a start-up condition determination section according to the present embodiment.

FIG. 5 shows example details of the start-up condition determination section 401.

In this example, whether all of the following conditions are established is determined by an AND circuit 501: the engine water temperature is equal to or higher than a prescribed temperature; a prescribed period of time has elapsed after a complete explosion; the engine speed is equal to or higher than a first prescribed speed and equal to or lower than a second prescribed speed; the difference between the atmospheric pressure and the intake pipe pressure is equal to or higher than a prescribed pressure; air-fuel ratio feedback is being performed; and no fault has been detected by any sensor.

Figure 6:
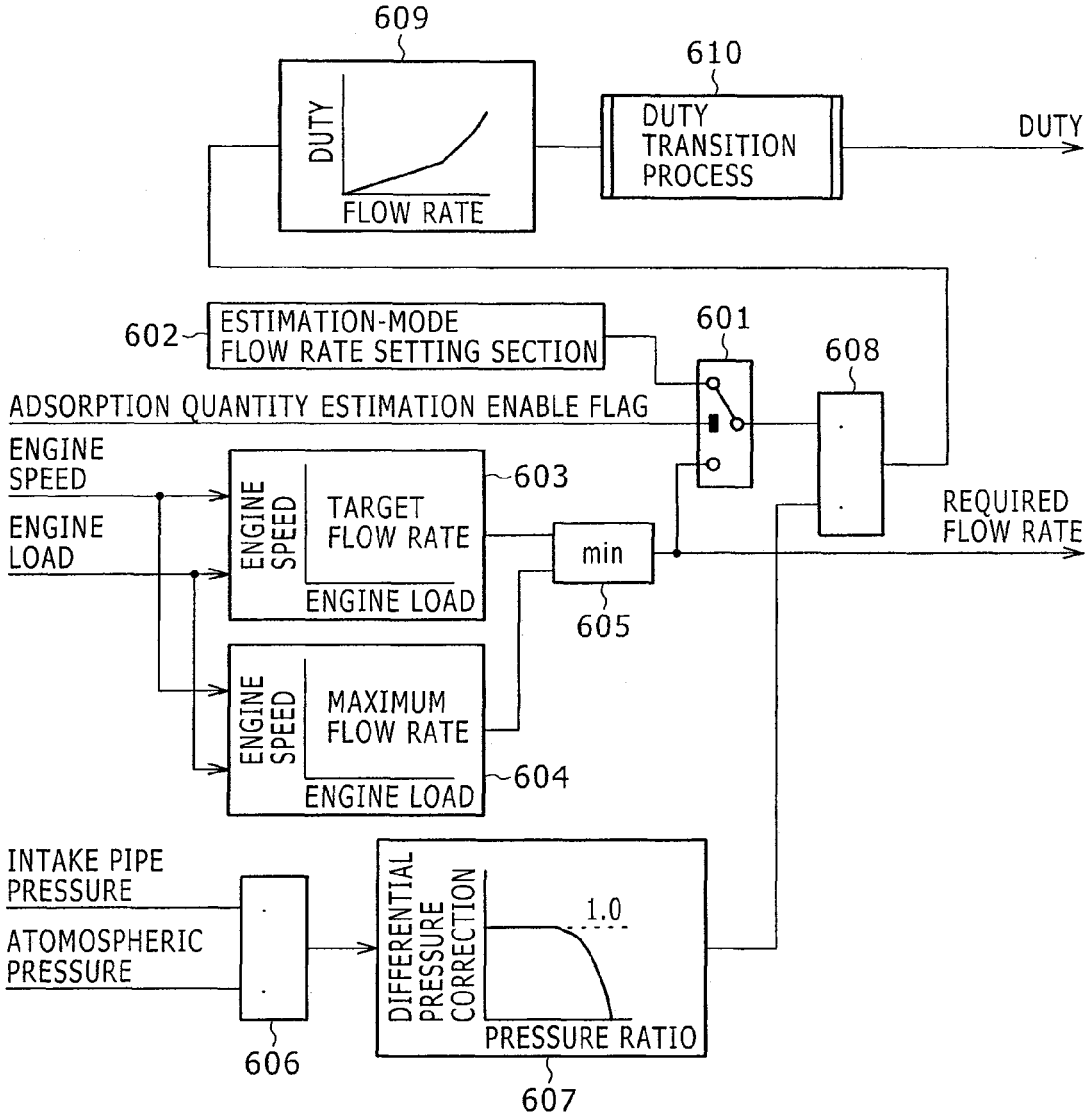
FIG. 6 is a block diagram showing example details of a purge quantity calculation section according to the present embodiment.

FIG. 6 shows example details of the purge quantity calculation section 402.

The purge quantity calculation section 402 outputs a driving duty ratio for the purge control valve 231 and a required flow rate. A selector 601 determines, based on an adsorption quantity estimation enable flag, whether adsorption quantity estimation is being performed. When adsorption quantity estimation is being performed, the selector 601 allows an estimation-mode flow rate setting section 602 to output a target flow rate.

A target flow rate search section 603 determines a target flow rate using a map of engine speed vs. engine load. A maximum flow rate search section 604 determines a maximum flow rate for each operating zone of the engine based on the engine speed and engine load. A selector 605 selects whichever is smaller between the target flow rate determined by the target flow rate search section 603 and the maximum flow rate determined by the maximum flow rate search section 604. The selected flow rate is outputted, together with a signal indicating the required flow rate, to the selector 601 so as to be selected when adsorption quantity estimation is not performed.

A pressure ratio calculation section 606 calculates a pressure ratio by dividing the intake pipe pressure by the atmospheric pressure. A differential pressure compensation value calculation section 607 calculates a differential pressure compensation value based on the pressure ratio calculated by the pressure ratio calculation section 606. A differential pressure compensation section 608 applies the differential pressure compensation value to the flow rate selected at the selector 601.

A duty setting section 609 determines, by searching a table, a driving duty ratio for the purge control valve 231 to be driven at the flow rate corrected by the differential pressure compensation. The duty ratio determined by the duty setting section 609 is inputted to a duty transition processing section 610 where the duty ratio is set to be achieved gradually based on a setting constant.

Figure 7:
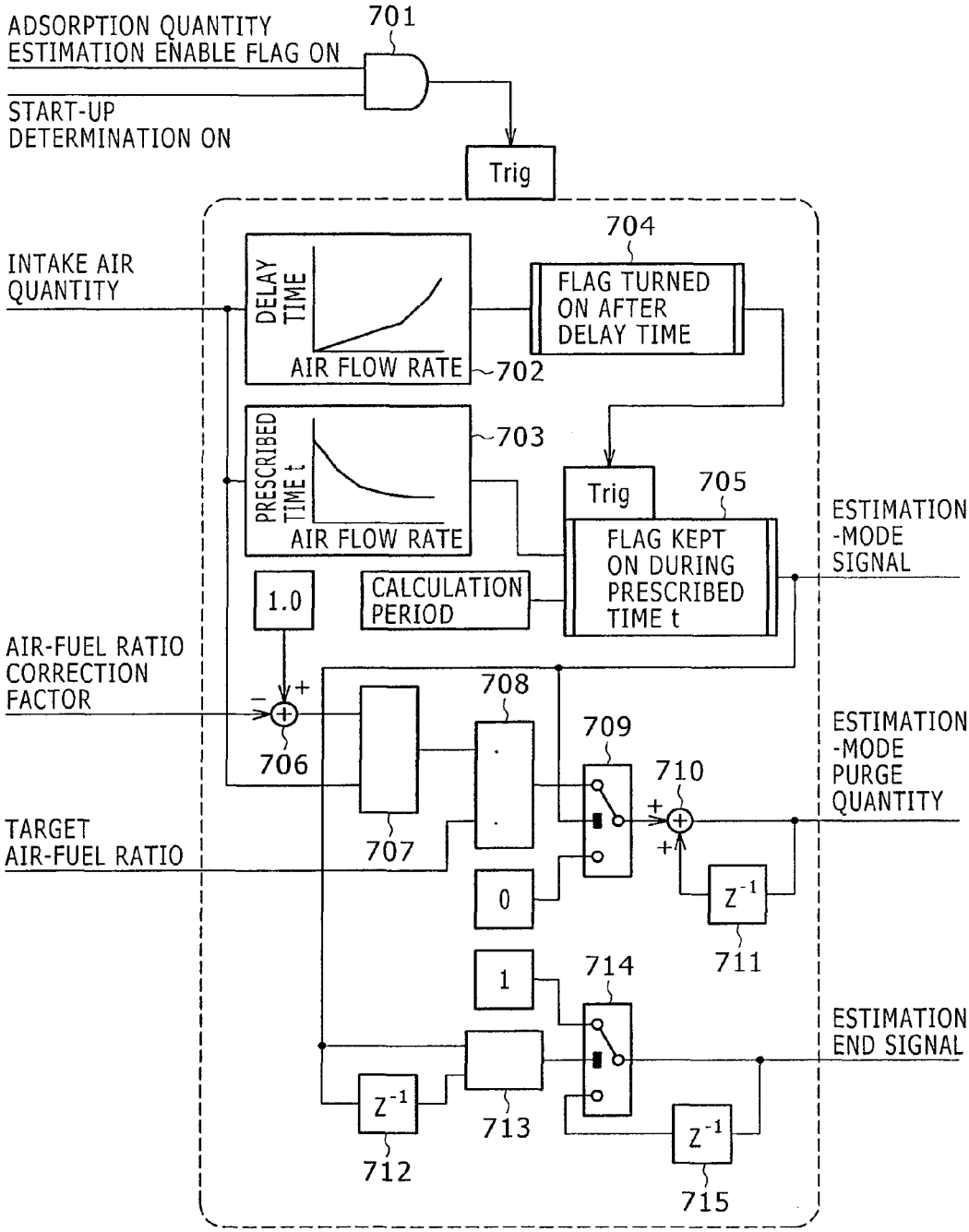
FIG. 7 is a block diagram showing example details of an adsorption quantity estimation section according to the present embodiment.

FIG. 7 shows example details of the adsorption quantity estimation section 403.

An AND circuit 701 serving as a start-up condition determination section of the adsorption quantity estimation section 403 determines whether conditions for enabling both adsorption quantity estimation and canister purge control have been established.

A delay time setting section 702 sets a delay time, by searching a table, based on the intake air quantity. A flag-on time setting section 703 sets a flag-on time t as a predetermined value, by searching a table, based on the intake air quantity.

A flag control section 704 turns a flag on when the delay time predetermined by the delay time setting section 702 passes. Another flag control section 705 keeps an estimation-mode signal on during time t predetermined by the flag-on time setting section 703. Calculators 706, 707 and 708, a selector 709, a calculator 710, and a previous value storage 711 calculate the quantity of fuel purged from the canister 230 during the time the estimation-mode signal is on. In the calculation, the value of (1−air-fuel ratio correction factor)× intake air quantity/target air-fuel ratio) is accumulated during the period with the estimation-mode signal on.

A calculator 712, a comparator 713, and a previous value storage 715 detect falling of the estimation-mode signal. When falling of the estimation-mode signal is detected, a search end signal is outputted.

Even though, in the present embodiment, it is assumed that adsorption quantity estimation is performed once between when the engine is started up and when the engine is stopped, adsorption quantity estimation may be performed twice under a prescribed condition.

Figure 8:
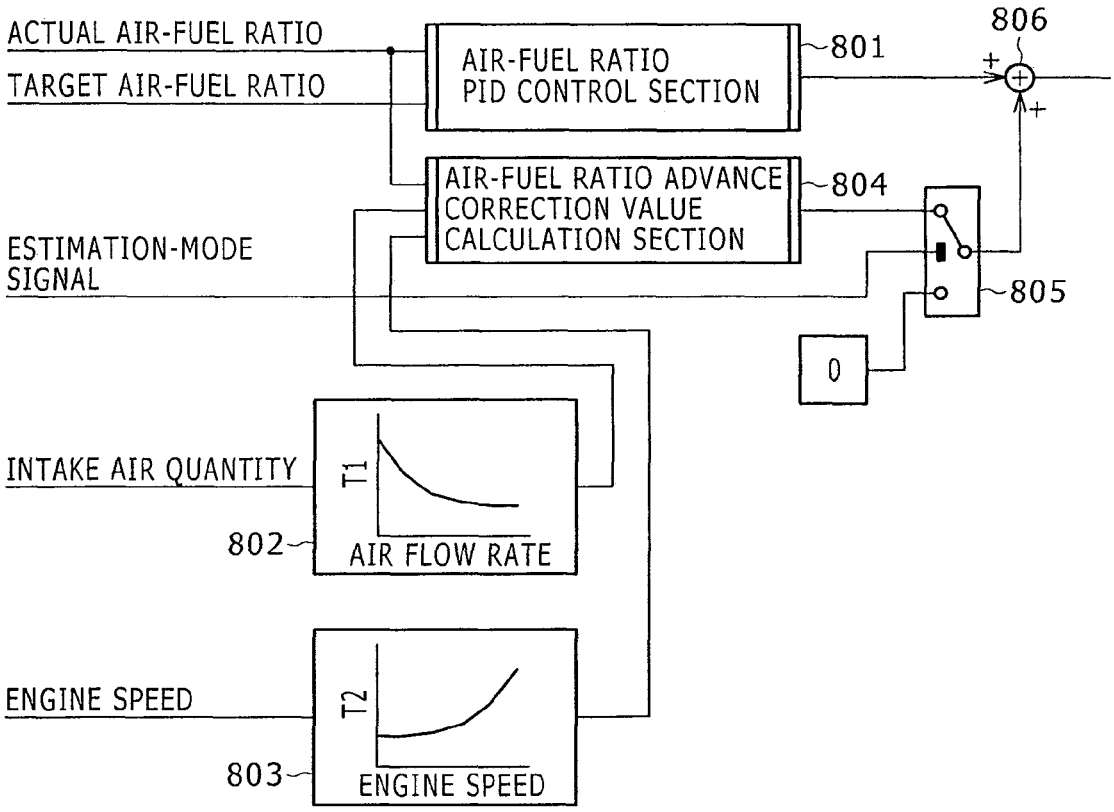
FIG. 8 is a block diagram showing, in detail, an example relationship between an air-fuel ratio advance correction section and air-fuel ratio PID control (air-fuel ratio feedback control) according to the present embodiment.

FIG. 8 shows an example relationship between the air-fuel ratio advance correction section 404 and air-fuel ratio PID control (air-fuel ratio feedback control) in detail.

An air-fuel ratio PID control section 801 performs air-fuel ratio PID control and calculates a correction factor based on an actual air-fuel ratio (measured air-fuel ratio) and a target air-fuel ratio.

A time-constant setting section (response delay setting unit) 802 sets a time constant (response delay of air-fuel ratio sensor ) T1, by searching a table, based on the intake air flow rate. Another time-constant setting section 803 sets a time constant (e.g. calculation delay) T2, by searching a table, based on the engine speed. Even through, in the present embodiment, time constants T1 and T2 are each set, by searching a table, based on a prescribed variable, they may be replaced by fixed constants for process simplification.

An air-fuel ratio advance correction value calculation section 804 calculates an air-fuel ratio advance correction value based on an actual air-fuel ratio and time constants T1 and T2. The calculation uses the following equations 1-1 to 1-3. Equation 1-1 represents a (secondary) delay system of a measured air-fuel ratio relative to a true air-fuel ratio. Equation 1-2 representing a discretized expression balancing out the delay system of equation 1-1 estimates a true air-fuel ratio. Equation 1-3 calculates an air-fuel ratio advance correction value based on the estimated true air-fuel ratio and a target air-fuel ratio.

$$\text{Actual air-fuel ratio (measured air-fuel ratio)} = \text{true air-fuel ratio} \times \frac{1}{(1+s\cdot T_1)(1+s\cdot T_2)} \qquad \text{Equation 1-1}$$

$$\text{True air-fuel ratio (estimated value)} = \left\{1+\frac{T_1+T_2}{\Delta t}+\frac{T_1\cdot T_2}{\Delta t^2}\right\}\times \text{actual air-fuel ratio } (n) - \left\{\frac{T_1+T_2}{\Delta t}+2\cdot\frac{T_1\cdot T_2}{\Delta t^2}\right\} \qquad \text{Equation 1-2}$$

T1: Response delay of air-fuel ratio sensor

T2: E.g. calculation delay

Δt: Calculation period $$\text{Air-fuel ratio advance correction value} = \frac{\text{true air-fuel ratio (estimated value)}}{\text{target air-fuel ratio}} \qquad \text{Equation 1-3}$$

A selector 805 and a calculator 806 add, only while an estimation-mode signal is outputted, an air-fuel ratio advance correction value calculated by the air-fuel ratio advance correction value calculation section 804 to a correction factor calculated by the air-fuel ratio PID control section 801.

Figure 9:
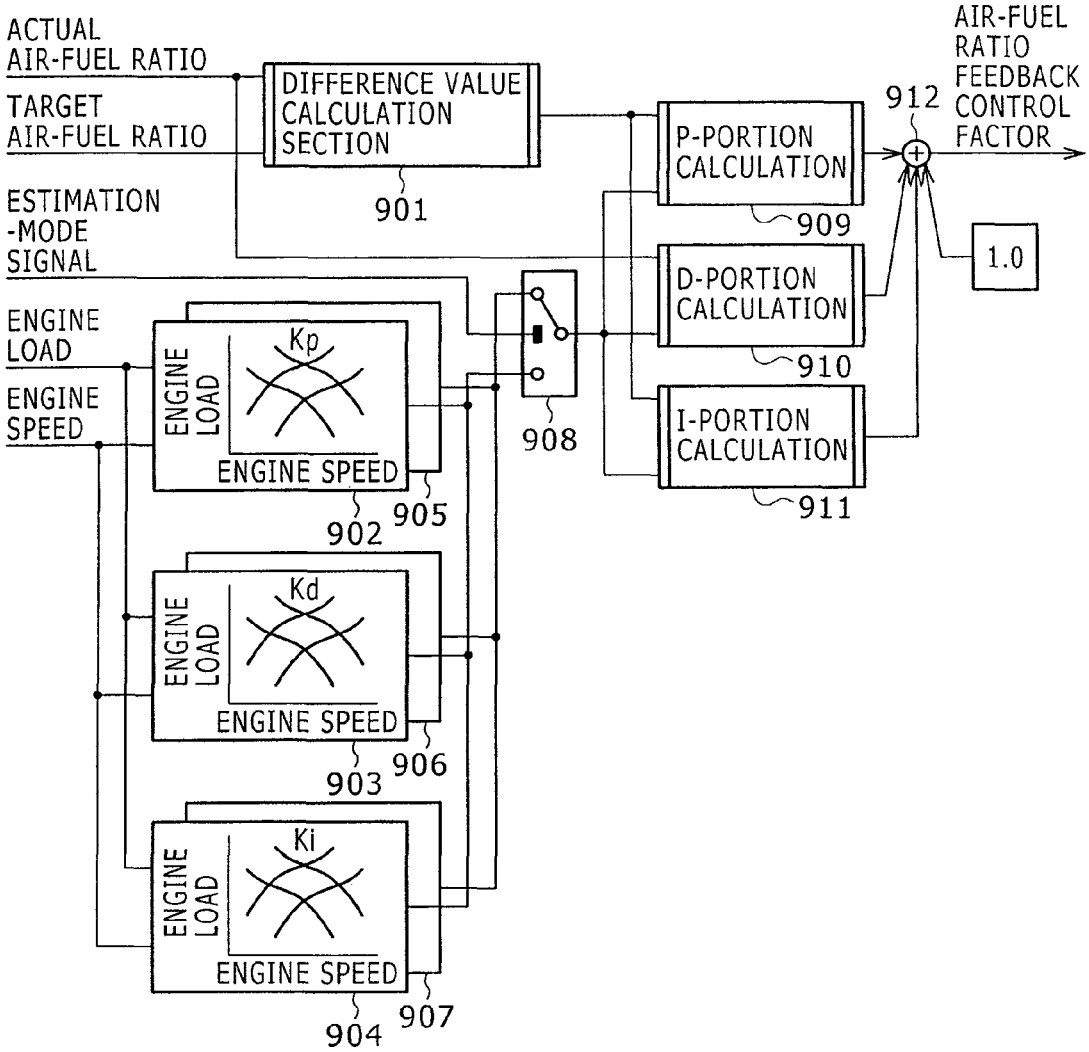
FIG. 9 is a block diagram showing, in detail, an example of air-fuel ratio PID control performed whereas no air-fuel ratio advance correction is performed.

FIG. 9 illustrates, in detail, an example of air-fuel ratio PID control performed with no air-fuel ratio advance correction performed.

A difference value calculation section 901 calculates a difference between an actual air-fuel ratio and a target air-fuel ratio. Gain setting sections 902, 903 and 904 set PID control gains (Kp, Ki, and Kd) with no estimation-mode signal outputted by searching maps based on the engine load and engine speed. Gain setting sections 905, 906 and 907 set PID control gains (Kp, Ki, and Kd) with an estimation-mode signal outputted by searching maps based on the engine load and engine speed.

A selector 908 makes switching to selectively output the PID control gains, determined using the maps, according to whether an estimation-mode signal is being outputted. A P-portion calculation section 909, an I-portion calculation section 910, and a D-portion calculation section 911 calculate the P, I and D portions of PID control based on the set gains, respectively. The following equations 2-1, 2-2 and 2-3 calculate the P, D, and I portions, respectively.

$$P \text{ portion} = Kp \times \text{difference value} \quad \text{Equation 2-1}$$

$$D \text{ portion} = Kd \times \frac{\text{actual air-fuel ratio } (n) - \text{actual air-fuel ratio } (n-1)}{\Delta 1} \quad \text{Equation 2-2}$$

$$I \text{ portion} = Ki \times \Sigma \text{ difference value} \quad \text{Equation 2-3}$$

$\Delta t$: Calculation period

The P, I and D portions are added up at a calculator 912 to work out an air-fuel ratio feedback control factor according to PID control.

Figure 10:
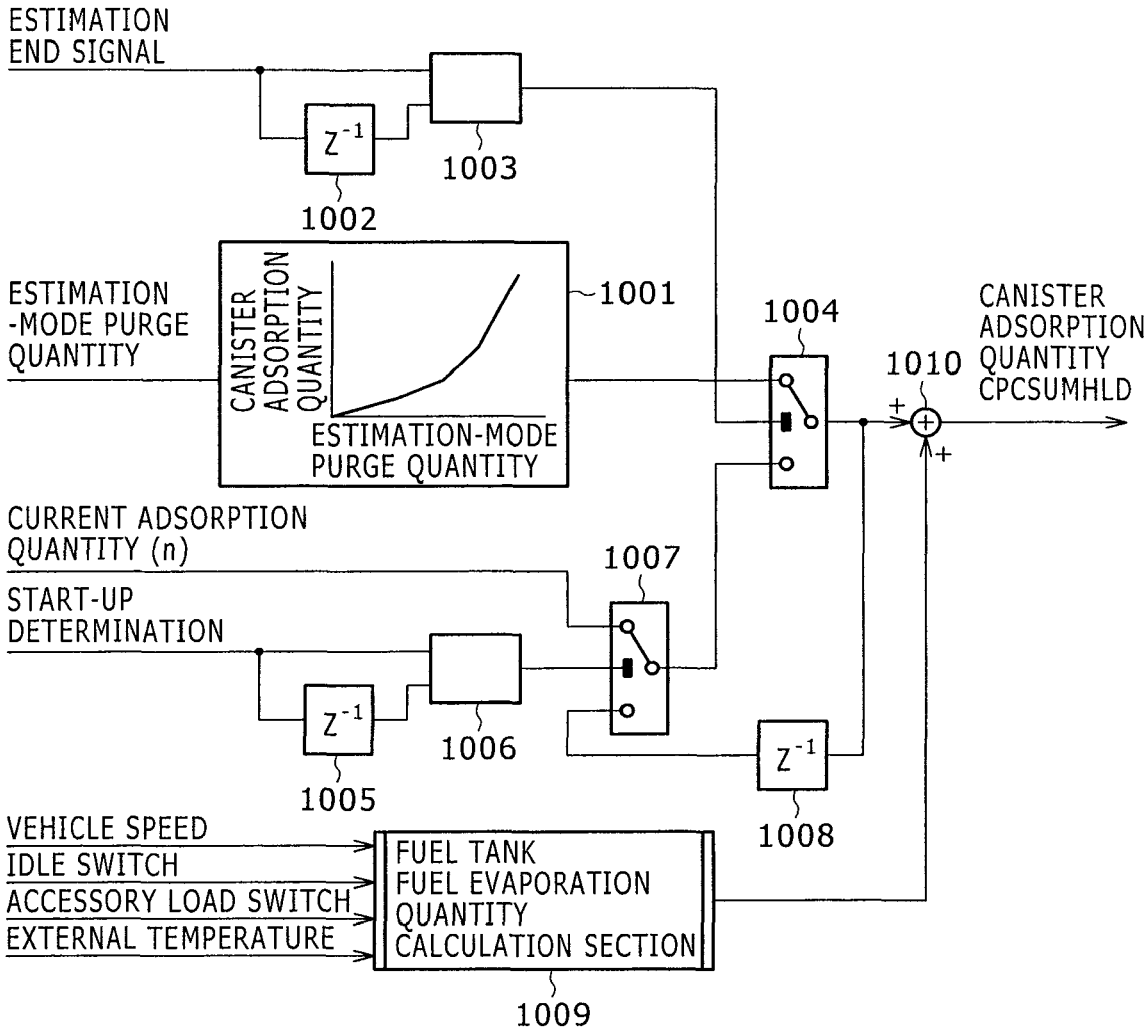
FIG. 10 is a block diagram showing example details of an adsorption quantity change calculation section according to the present embodiment.

FIG. 10 shows example details of the adsorption quantity change calculation section 408.

An adsorption quantity calculation section 1001 determines a canister adsorption quantity, by searching a table, based on the purge quantity with estimation performed.

A previous value storage 1002 and a comparator 1003 detect rising of an estimation end signal. Once rising of an estimation end signal is detected, a selector 1007 and a previous value storage 1008 retain the canister adsorption quantity until starting of canister purge control is detected.

When the previous value storage 1008 and the comparator 1007 detect starting of canister purge control, the current canister adsorption quantity, being described later, is retained.

A fuel tank fuel evaporation quantity calculation section 1009 calculates the quantity of fuel evaporating from the fuel tank 220 per unit time based on the vehicle speed, idle switch setting, accessory load switch setting, and external temperature. The fuel evaporation quantity thus calculated is added, at a calculator 1010, to the canister adsorption quantity. The calculator 1010 then outputs a canister adsorption quantity CPCSUMHLD.

Figure 11:
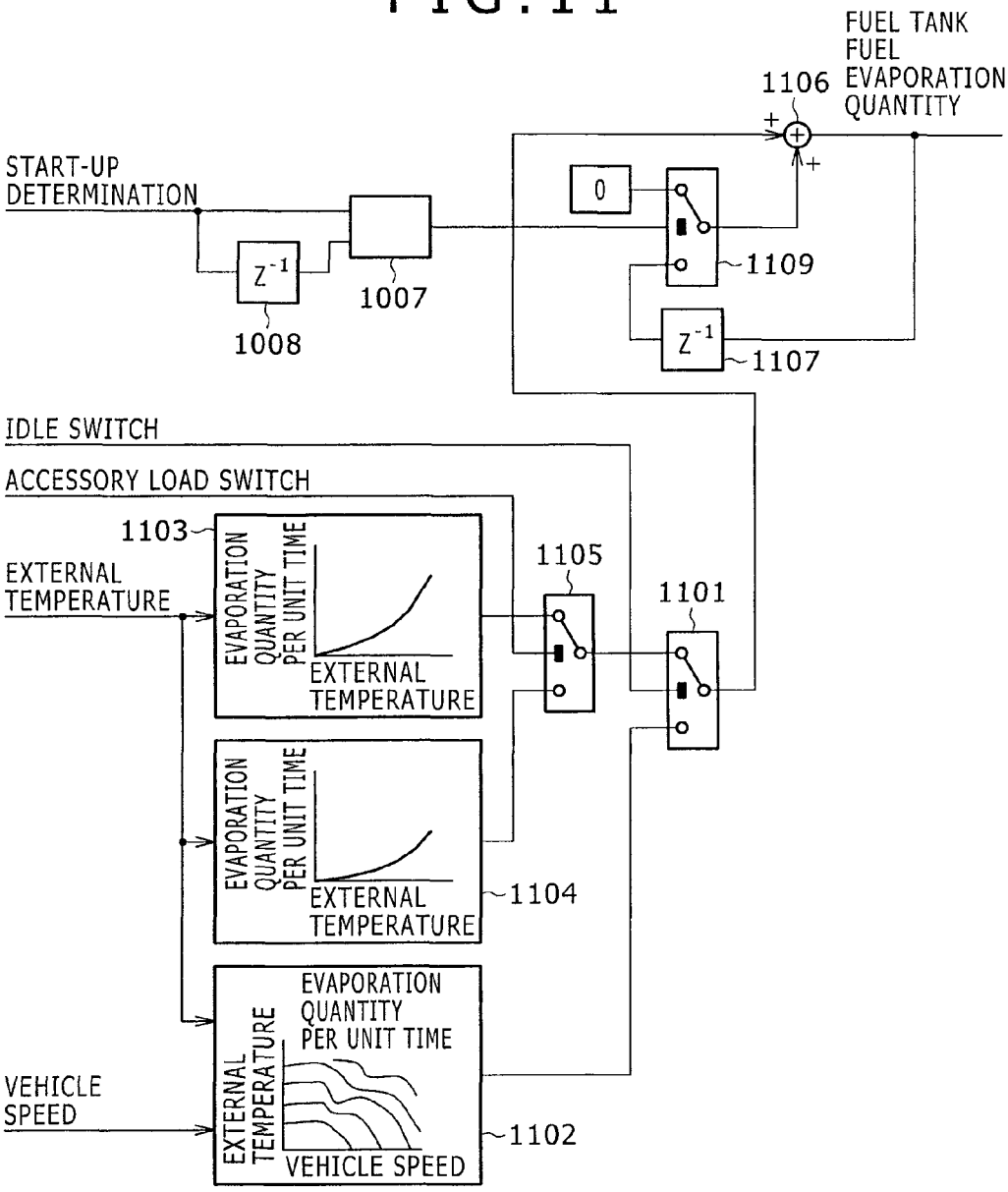
FIG. 11 is a block diagram showing example details of a fuel evaporation quantity calculation section according to the present embodiment.

FIG. 11 shows example details of the fuel tank fuel evaporation quantity calculation section 1009.

A selector 1101 determines whether the engine is idling. An idle-time fuel evaporation quantity calculation section 1103 determines, by searching a table, based on the external temperature, a fuel evaporation quantity per unit time with the engine idling and the accessory load switch on. Another idle-time fuel evaporation quantity calculation section 1104 determines, by searching a table, based on the external temperature a fuel evaporation quantity per unit time with the engine idling and the accessory load switch off. A selector 1105 determines whether the accessory load switch is on or off so as to select either of the above fuel evaporation quantities.

A non-idle-time fuel evaporation quantity calculation unit 1102 determines, by searching a map, based on the external temperature and vehicle speed a fuel evaporation quantity per unit time. The fuel evaporation quantity determined by the non-idle-time fuel evaporation quantity calculation unit 1102 is selected by the selector 1101 when the engine is not idling.

A calculator 1106 and a previous value storage 1107 add up the fuel evaporation quantities selected by the selector 1101 to work out a total fuel evaporation quantity.

The total fuel evaporation quantity is, when starting of canister purge control is detected by the previous value storage 1008 and the comparator 1007, reset to zero by an operation of the selector 1109.

Figure 12:
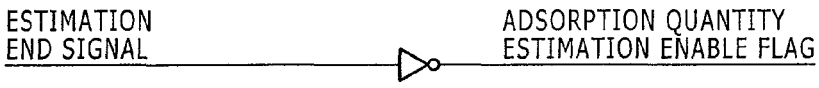
FIG. 12 is a block diagram showing an example of setting an adsorption quantity estimation enable flag according to the present embodiment.

FIG. 12 illustrates an example of setting an adsorption quantity estimation enable flag. When an estimation end signal turns on, the adsorption quantity estimation enable signal is turned off.

Figure 13:
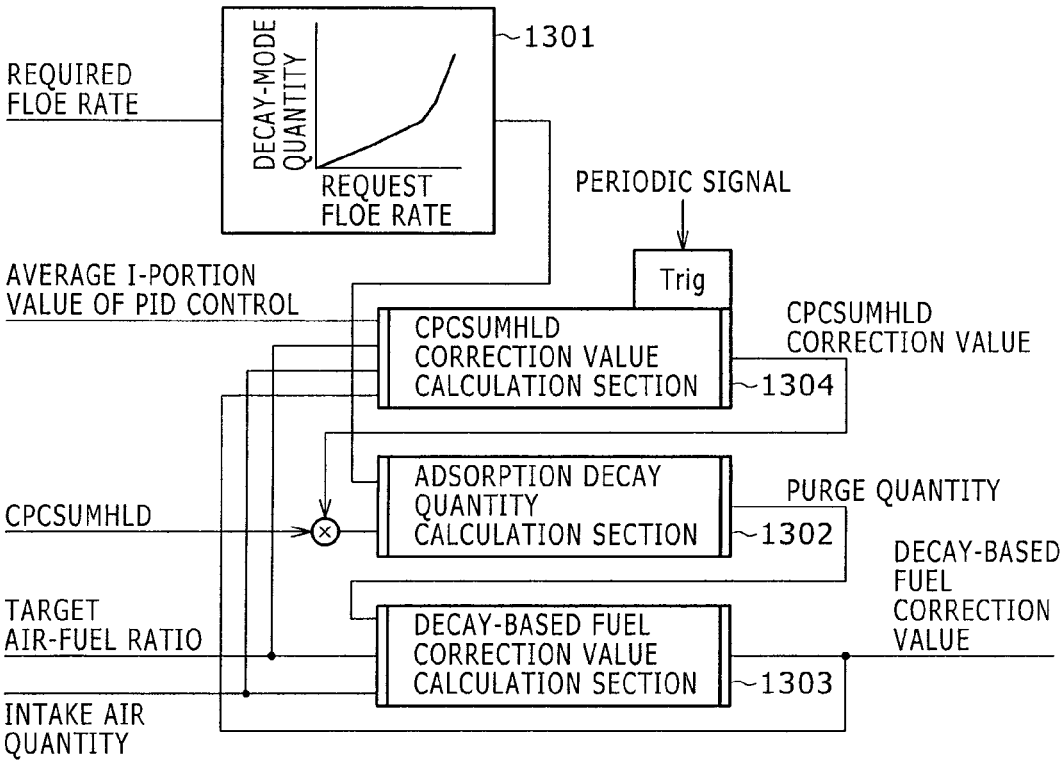
FIG. 13 is a block diagram showing example details of an air-fuel ratio correction factor calculation section according to the present embodiment.

FIG. 13 shows example details of the air-fuel ratio correction factor calculation section 409.

A decay time-constant setting section 1301 determines a decay time-constant T, by searching a table, based on the required flow rate outputted from the purge quantity calculation section 402.

An adsorption decay quantity calculation section 1302 calculates a quantity of fuel purged from the canister 230 based on a decay time-constant T and the canister adsorption quantity CPCSUMHLD corrected as described later.

Equation 3-1 is an expression of decay. Equation 3-2 is obtained by transforming equation 3-1. Based on these equations, the quantity of fuel purged from the canister 230 can be calculated using equation 3-3. Equation 3-4 is obtained by discretizing equation 3-3. The adsorption decay quantity calculation section 1302 executes equation 3-4. Equation 3-5 represents a current adsorption quantity.

$$\text{Current adsorption quantity} = CPCSUMHLD \times \left(1 - \frac{1}{(1 \times s \cdot T)}\right) \quad \text{Equation 3-1}$$

$$\text{Current adsorption quantity} = CPCSUMHLD - CPCSUMHLD \times \frac{1}{(1 \times s \cdot T)} \quad \text{Equation 3-2}$$

$$\text{Purge quantity} = CPCSUMHLD \times \frac{1}{(1 \times s \cdot T)} \quad \text{Equation 3-3}$$

$$\text{Purge quantity } (n) = CPCSUMHLD \times \frac{\Delta t}{\Delta t + T} + \text{purge quantity } (n-1) \times \frac{T}{\Delta t + T} \quad \text{Equation 3-4}$$

$$\text{Current adsorption quantity } (n) = \text{current adsorption quantity } (n-1) - \text{purge quantity } (n) \quad \text{Equation 3-5}$$

$\Delta t$: Calculation period

A decay-based fuel correction value calculation section 1303 calculates a decay-based fuel correction value from a target air-fuel ratio, an intake air quantity, and a purge quantity calculated by the adsorption decay quantity calculation section 1302. To calculate a decay-based fuel correction value, the decay-based fuel correction value calculation section 1303 uses equation (4).

$$\text{Decay-based correction value} = \frac{\frac{IAQ}{TAFR}}{\frac{IAQ}{TAFR} + \frac{PQ(n) - PQ(n-1)}{\Delta 1}} - 1$$

IAQ: intake air quantity

TAFR: target air-fuel ratio

PQ: purge quantity

A canister adsorption quantity correction value calculation section 1304 calculates a correction value to be applied to the canister adsorption quantity CPCSUMHLD using equations (5-1) and (5-2) based on an average value of the I portion of air-fuel ratio PID control, a target air-fuel ratio, an intake air quantity, and a decay-based fuel correction value calculated by the decay-based fuel correction value calculation section 1303.

Equations 5-1 and 5-2 are used to calculate a correction value for correcting the canister adsorption quantity CPCSUMHLD. Namely, equation 5-2 calculates, from an average value of the I portion of air-fuel ratio PID control, a ratio of deviation of a decay-based fuel correction value. Equation 5-1 calculates a correction value for correcting the canister adsorption quantity CPCSUMHLD.

$$CPCSUMHLD \text{ correction value} = \frac{\left\{\left\{\frac{PQ(n)-PQ(n-1)}{\Delta 1}+\frac{IAQ}{TAFR}\right\}\right\}-\frac{IAQ}{TAFR}}{\frac{PQ(n)-PQ(n-1)}{\Delta 1}} \quad \text{Equation 5-1}$$

$$\text{Deviation ratio of } DCV = \frac{DCV + \text{average value of } I \text{ portion of } PID \text{ control}}{DCV} \quad \text{Equation 5-2}$$

PQ: purge quantity

IAQ: intake air quantity

TAFR: target air-fuel ratio

DCV: decay-based correction value

Figure 14:
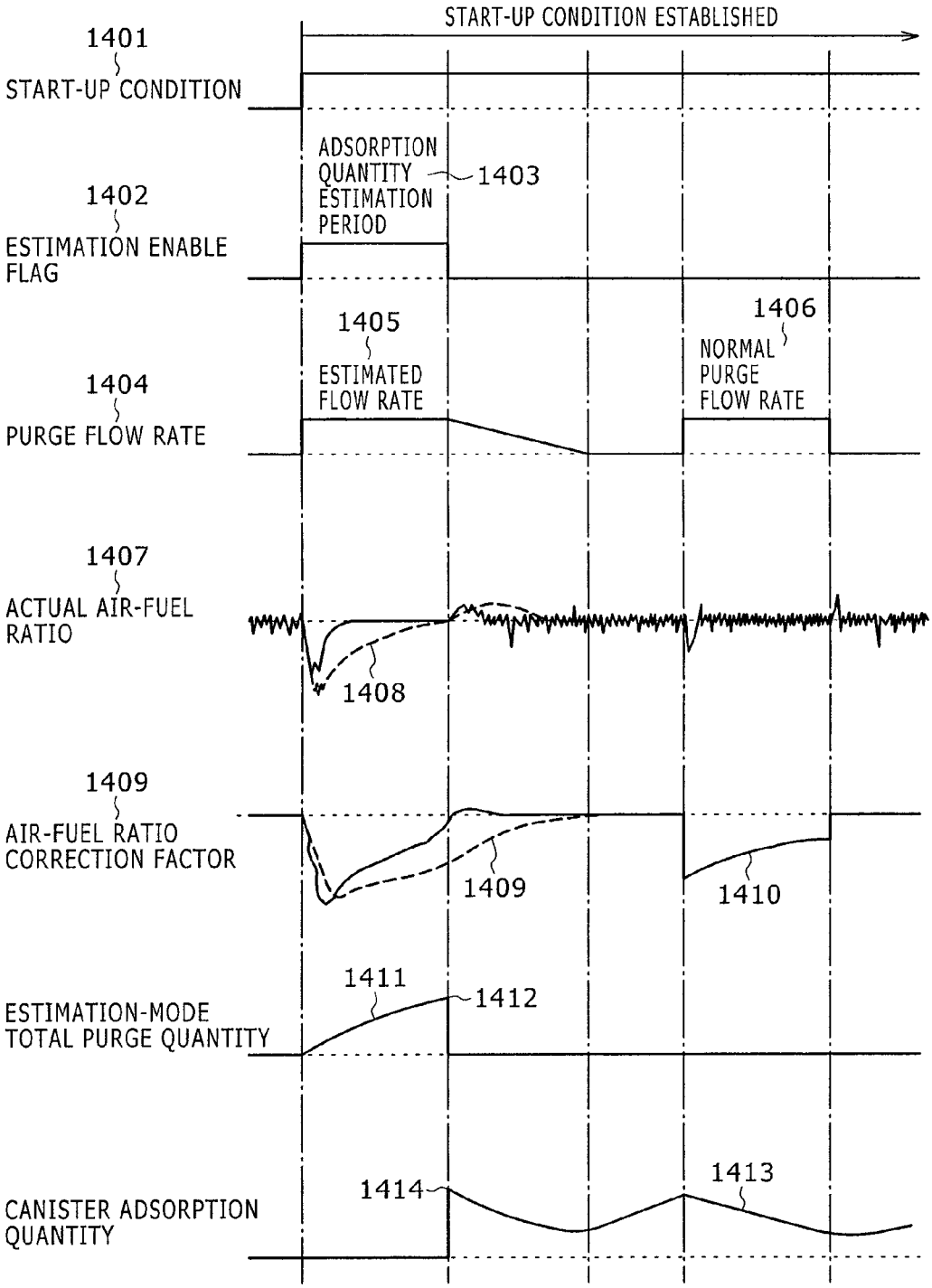
FIG. 14 is a time chart showing the behavior of control variables of the engine control device in which canister purge control is performed according to the present embodiment.

FIG. 14 shows the behavior of control variables of the engine control device 250 that performs canister purge control.

Line 1401 represents a start-up condition turning on from off. Line 1402 represents an estimation enable signal. Estimation is enabled during a section 1403.

Line 1404 represents a purge flow rate. Fuel is purged at an estimated flow rate in a section 1405 and at a normal purge flow rate in a section 1406. The estimated flow rate is reduced through a transition process to gradually approach zero from when searching is finished.

Line 1407 represents an actual air-fuel ratio of exhaust gas. Line 1408 represents an actual air-fuel ratio with no air-fuel ratio advance correction performed.

Line 1409 represents an air-fuel ratio correction factor. Line 1409' represents an air-fuel ratio correction factor with no air-fuel ratio advance correction performed. Section 1410 represents a normal purge state subjected to decay-based correction. Line 1411 represents a purge quantity totalized in a state where estimation is performed. Estimation ends at time 1412. The total purge quantity at that time is indicative a canister adsorption quantity.

Line 1413 represents a canister adsorption quantity which is determined at time 1414 based on the total purge quantity and is then adjusted depending on the vehicle condition and a target flow rate.

Figure 15:
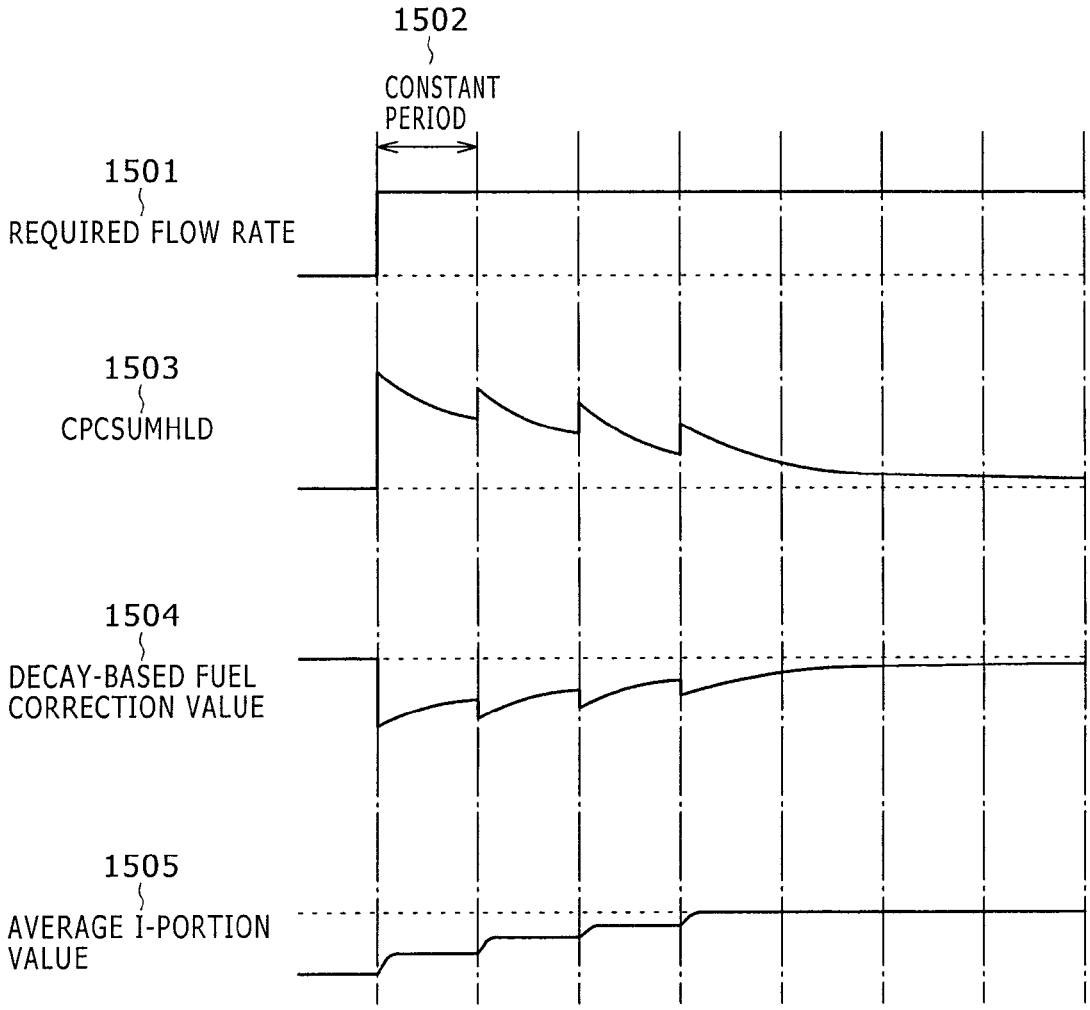
FIG. 15 is a time chart showing the behavior of control variables used in calculations for correcting the canister adsorption quantity CPCSUMHLD according to the present embodiment.

FIG. 15 shows the behavior of control variables used in calculations for correcting the canister adsorption quantity CPCSUMHLD.

Line 1501 represents a required flow rate for fuel flowing through the purge control valve 231. A section 1502 represents a period during which the correction calculation is performed. Line 1503 represents variation of the canister adsorption quantity CPCSUMHLD. Line 1504 represents a decay-based fuel correction value. Line 1505 represents an average value of the I portion of air-fuel ratio PID control. In the present example, every time the canister adsorption quantity CPCSUMHLD is corrected, the decay-based fuel correction factor becomes smaller and the average value of the I portion comes closer to 0.

Figure 16:
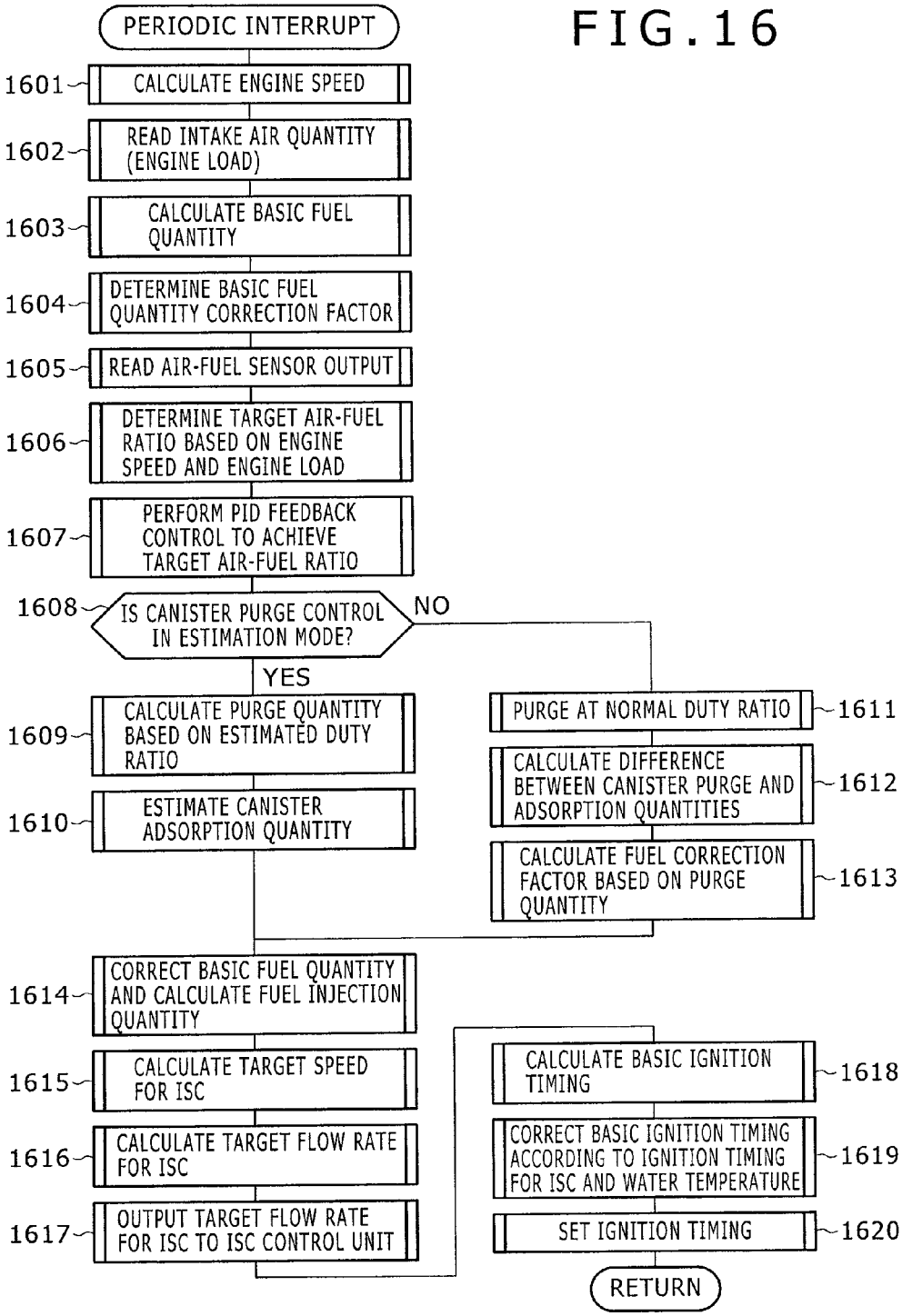
FIG. 16 is a flowchart of a routine performed by the engine control device according to the present embodiment.

FIG. 16 is a flowchart of example canister purge control performed by the engine control device 250.

In step 1601, the engine speed is calculated by counting the number of electrical signals, mostly representing pulse signal changes, inputted per unit time from the crank angle sensor 219. In step 1602, an air flow rate determined by processing the output voltage of the thermal air flow meter 202 for voltage-to-flow rate conversion is read.

In step 1603, the basic fuel quantity is calculated based on the engine speed and intake air flow rate. In step 1604, a basic fuel correction factor is determined, by searching a map, based on the engine speed and basic fuel quantity.

In step 1605, the actual air-fuel ratio determined by processing the output voltage of the air-fuel ratio sensor 215 for voltage-to-air-fuel ratio conversion is read. In step 1606, a target air-fuel ratio is determined, by searching a map, based on the engine speed and basic fuel quantity (load). In step 1607, based on the target air-fuel ratio and actual air-fuel ratio, PID control toward the target air-fuel ratio is performed.

In step 1608, whether canister purge control is in estimation mode is determined. When the canister purge control is determined to be in estimation mode, steps 1609 and 1610 are subsequently executed. In step 1609, the purge quantity per unit time is determined based on an estimated duty ratio (estimated flow rate).

In step 1610, a canister adsorption quantity is estimated based on the purge quantity per unit time.

When, in step 1608, the canister purge control is determined not to be in estimation mode, steps 1611, 1612 and 1613 are subsequently executed. In step 1611, canister purge is carried out at a normal duty ratio (at a normal flow rate). In step 1612, a change in adsorption quantity is calculated based on quantities of fuel charged to and purged from the canister. In step 1613, a fuel correction factor is calculated based on the purge quantity.

In step 1614, the basic fuel quantity is corrected using the basic fuel correction factor, the air-fuel ratio correction factor determined through PID control and the purge-quantity-based fuel correction factor, and a fuel injection quantity is calculated.

In step 1615, a target idle speed is calculated. In step 1616, a target ISC flow rate for achieving the target idle speed is calculated. In step 1617, the target ISC flow rate is outputted to the ISC control unit. In step 1618, basic ignition timing is calculated based on the engine speed and engine load (basic fuel quantity). In step 1619, the basic ignition timing is corrected, for example, according to the water temperature. In step 1620, the corrected ignition timing is set.

Figure 17:
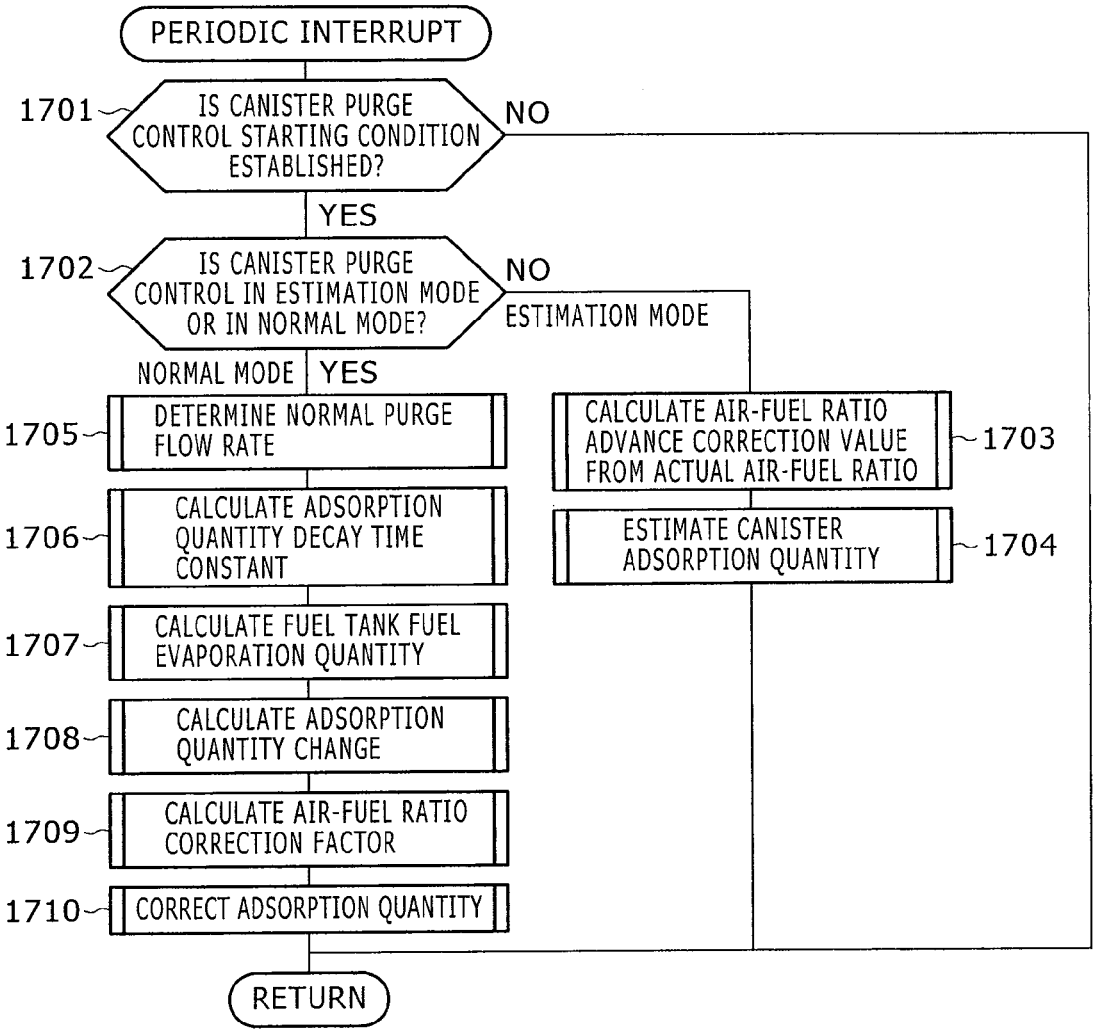
FIG. 17 is a flowchart of a routine performed by the canister purge control unit according to the present embodiment.

FIG. 17 is a flowchart of a control routine performed by the canister purge control unit 106.

In step 1701, whether the start-up condition for canister purge control has been established is determined. When the condition is determined to have been established, whether the canister purge control is in estimation mode or in normal mode is determined in step 1702. When the control is determined to be in estimation mode, an air-fuel ratio advance correction value is calculated based on an actual air-fuel ratio in step 1703.

In step 1704, the adsorption quantity of the canister 230 is estimated. When, in step 1702, the canister purge control is determined to be in normal mode, a normal purge flow rate is determined in step 1705. In step 1703, a decay time-constant of the adsorption quantity of the canister 230 is calculated. Instep 1708, a change in the adsorption quantity is calculated based on the decay time-constant and vehicle condition. In step 1709, a purge-quantity-based fuel correction factor is calculated based on the purge quantity corresponding to the change in the adsorption quantity. In step 1710, the adsorption quantity is corrected, for example, based on an average value of the I portion of air-fuel ratio PID control.

Figure 18:
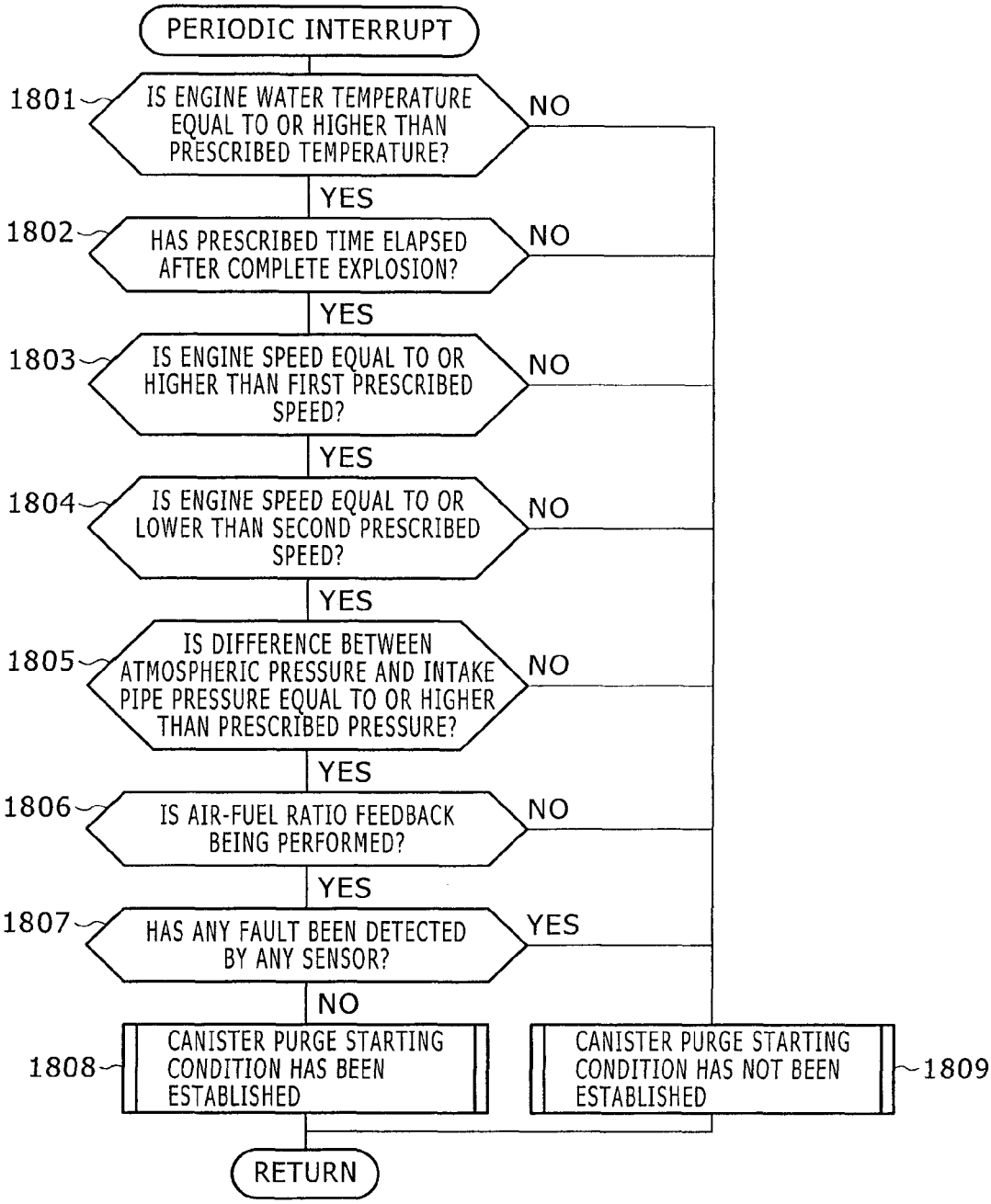
FIG. 18 is a flowchart of a routine performed by the start-up condition determination section according to the present embodiment.

FIG. 18 is a flowchart of a routine performed by the start-up condition determination section 401.

In steps 1801 through 1807, whether conditions for starting a canister purge, i.e. conditions as to engine water temperature, time having elapsed after a complete explosion, engine speed, difference between atmospheric pressure and intake pipe pressure, whether air-fuel ratio feedback is being performed, and fault detection by various sensors have been established is determined. When all the above conditions are determined to have been established, it is determined in step 1808 that the canister purge start-up condition has been established. When any of the above conditions is determined not to have been established, it is determined in step 1809 that the canister purge start-up condition has not been established.

Figure 19:
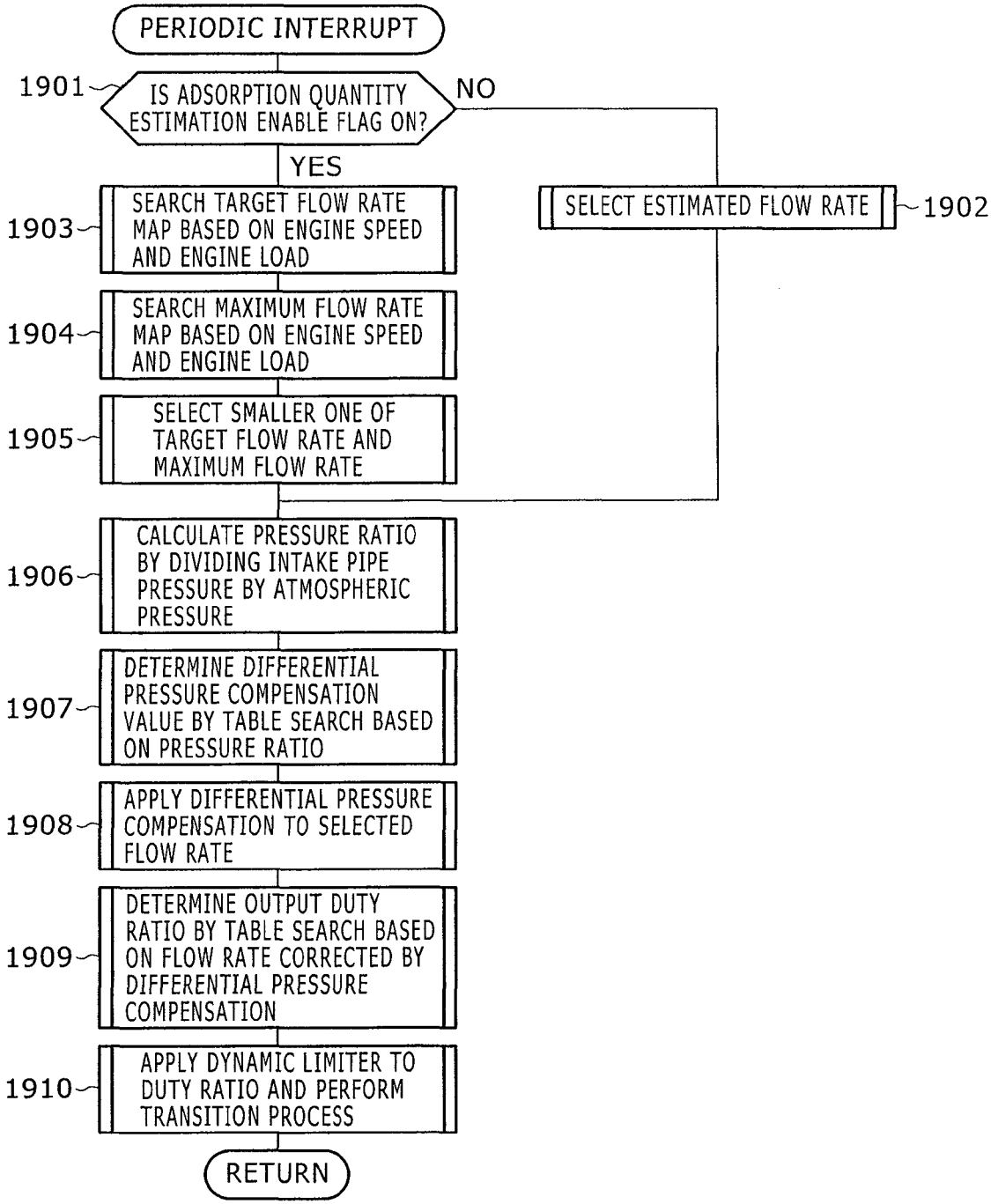
FIG. 19 is a flowchart of a routine performed by the purge quantity calculation section according to the present embodiment.

FIG. 19 is a flowchart of a routine performed by the purge quantity calculation section 402.

In step 1901, whether adsorption quantity estimation is enabled is determined. When the adsorption quantity estimation is determined to be disabled, an estimated flow rate is selected as a target flow rate in step 1902.

When the adsorption quantity estimation is determined to be enabled, a target flow rate is determined, by searching a map, based on the engine speed and engine load in step 1903, and a maximum flow rate is determined, by searching a map, based on the engine speed and engine load in step 1904.

In step 1905, the target flow rate and the maximum flow rate are compared, and the smaller one is selected as a target flow rate. In step 1906, a pressure ratio is calculated by dividing the intake pipe pressure by the atmospheric pressure. In step 1907, a differential pressure compensation value is determined, by searching a table, based on the pressure ratio. In step 1908, the differential pressure compensation is applied to the target flow rate. In step 1909, an output duty ratio is determined, by searching a table, based on the flow rate to which the differential pressure compensation has been applied. In step 1910, a dynamic limiter is applied to the duty ratio thus determined, and transition processing is performed.

Figure 20:
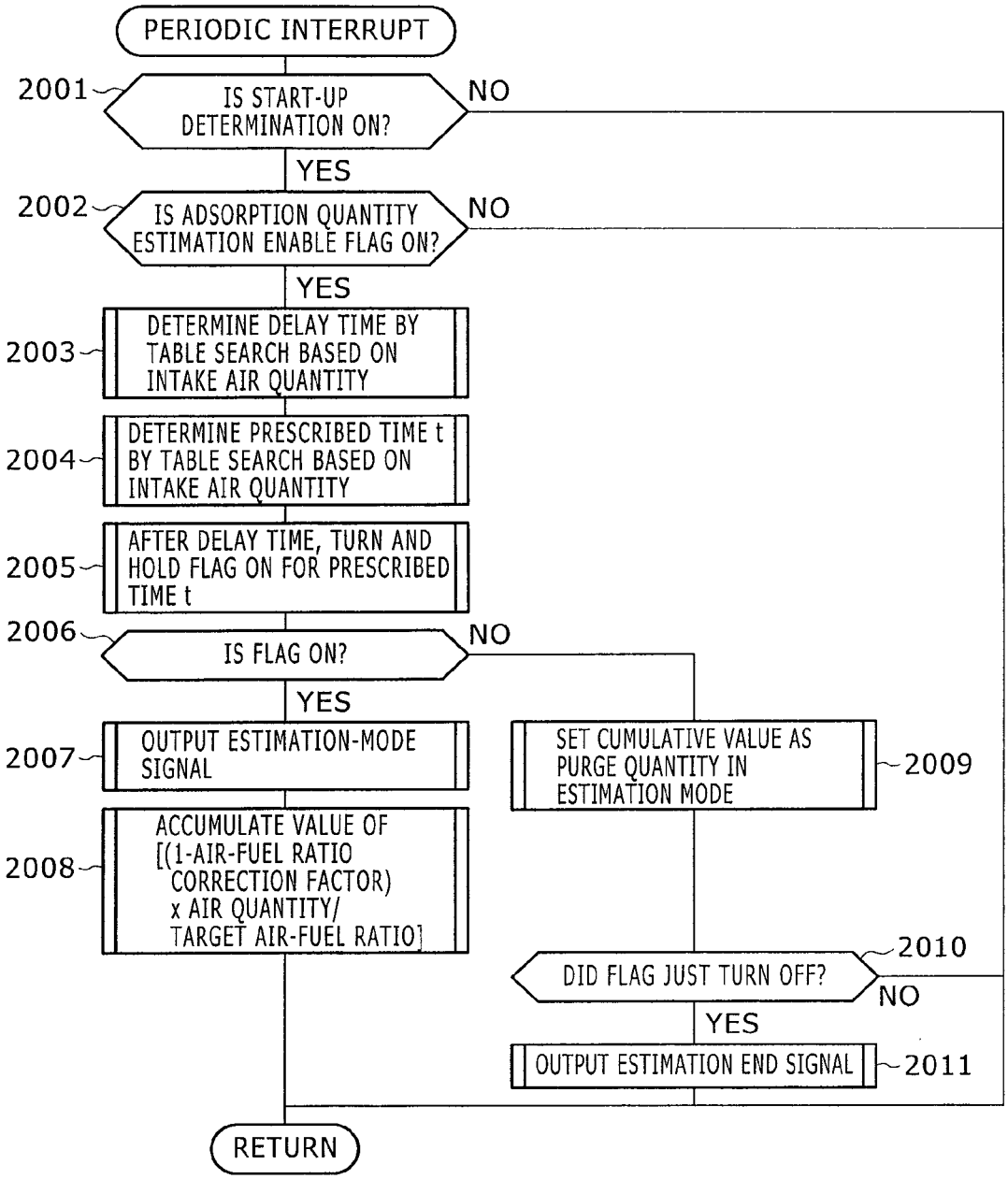
FIG. 20 is a flowchart of a routine performed by the adsorption quantity estimation section according to the present embodiment.

FIG. 20 is a flowchart of a routine performed by the adsorption quantity estimation section 403.

In steps 2001 and 2002, whether conditions for adsorption quantity estimation have been established is determined. The conditions are determined to have been established when the canister purge control start-up condition is established and the adsorption quantity estimation is enabled.

When the conditions are determined to have been established, a delay time is determined, by searching a table, based on the intake air quantity in step 2003, and prescribed time 1 is determined, by searching a table, based on the intake air quantity.

In step 2005, when the delay time elapses after the conditions are determined, in steps 2001 and 2002, to have been established, a flag is turned on and kept on for a prescribed time t.

In step 2006, whether the flag is on is determined. When the flag is determined to be on, an estimation-mode signal is outputted in step 2007 as long as the flag is on.

In step 2008, a value of [(1−air-fuel ratio correction factor)×air quantity/target air-fuel ratio] is accumulated.

When, in step 2006, the flag is determined to be off, the current cumulative quantity is set as the purge quantity with estimation being made in step 2009.

In step 2010, whether the flag has turned off is determined. When the flag is determined to have turned off, an estimation end signal is outputted in step 2011.

Figure 21:
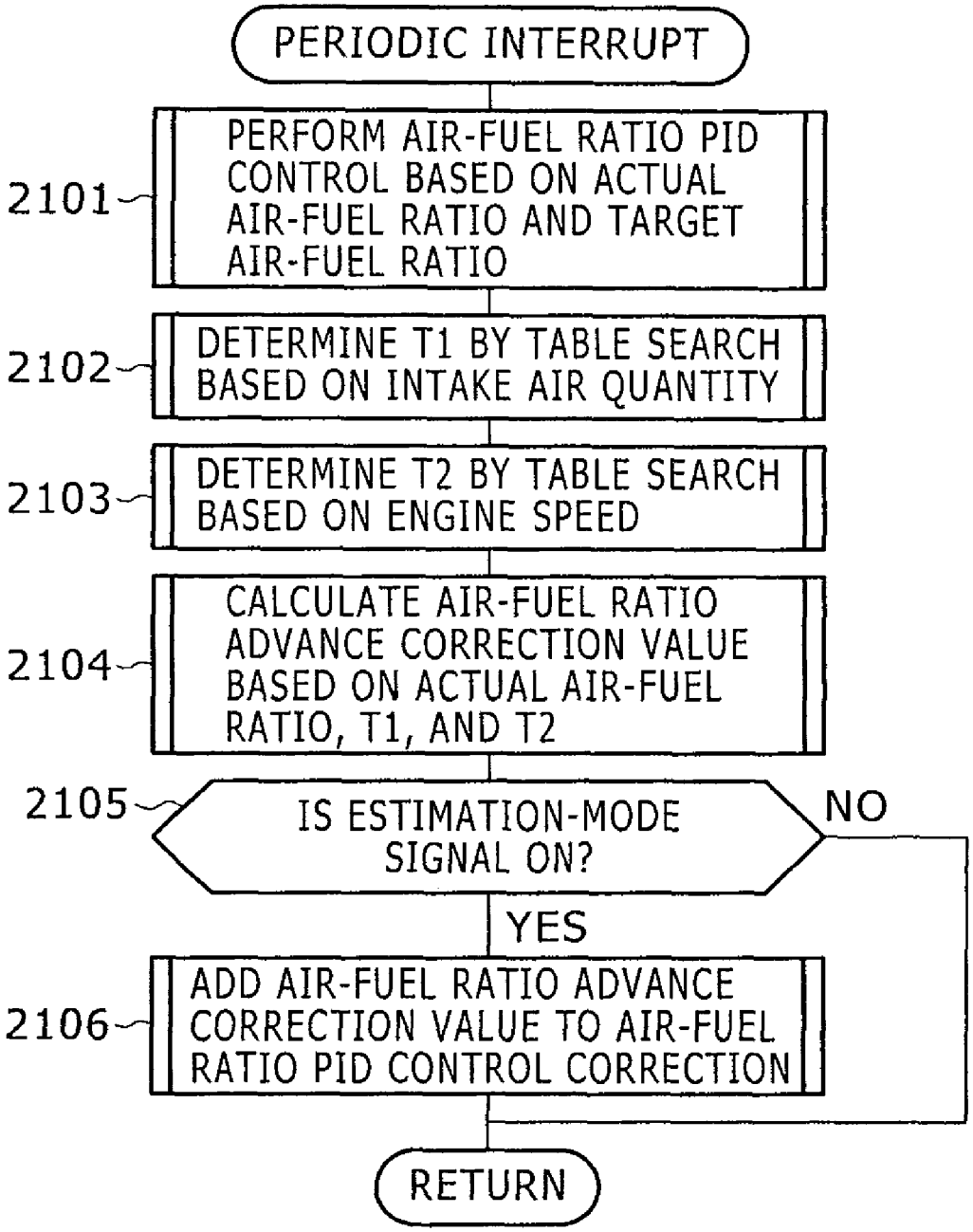
FIG. 21 is a flowchart of a routine performed by the air-fuel ratio advance correction section and air-fuel ratio PID control (air-fuel ratio feedback control) according to the present embodiment.

FIG. 21 is a flowchart of a routine performed by the air-fuel ratio advance correction section 404 and air-fuel ratio PID control (air-fuel ratio feedback control).

In step 2101, air-fuel ratio PID control is performed based on an actual air-fuel ratio and a target air-fuel ratio. In step 2102, time-constant T1 is determined, by searching a table, based on the intake air quantity. In step 2103, time-constant T2 is determined, by searching a table, based on the engine speed.

In step 2104, an air-fuel ratio advance correction value is calculated based on an actual air-fuel ratio, a target air-fuel ratio, and time-constants T1 and T2.

In step 2105, whether an estimation-mode signal is outputted is determined. When the estimation-mode signal is determined to be outputted, the air-fuel ratio advance correction value is added, in step 2106, to the correction factor determined by air-fuel ratio PID control.

Figure 22:
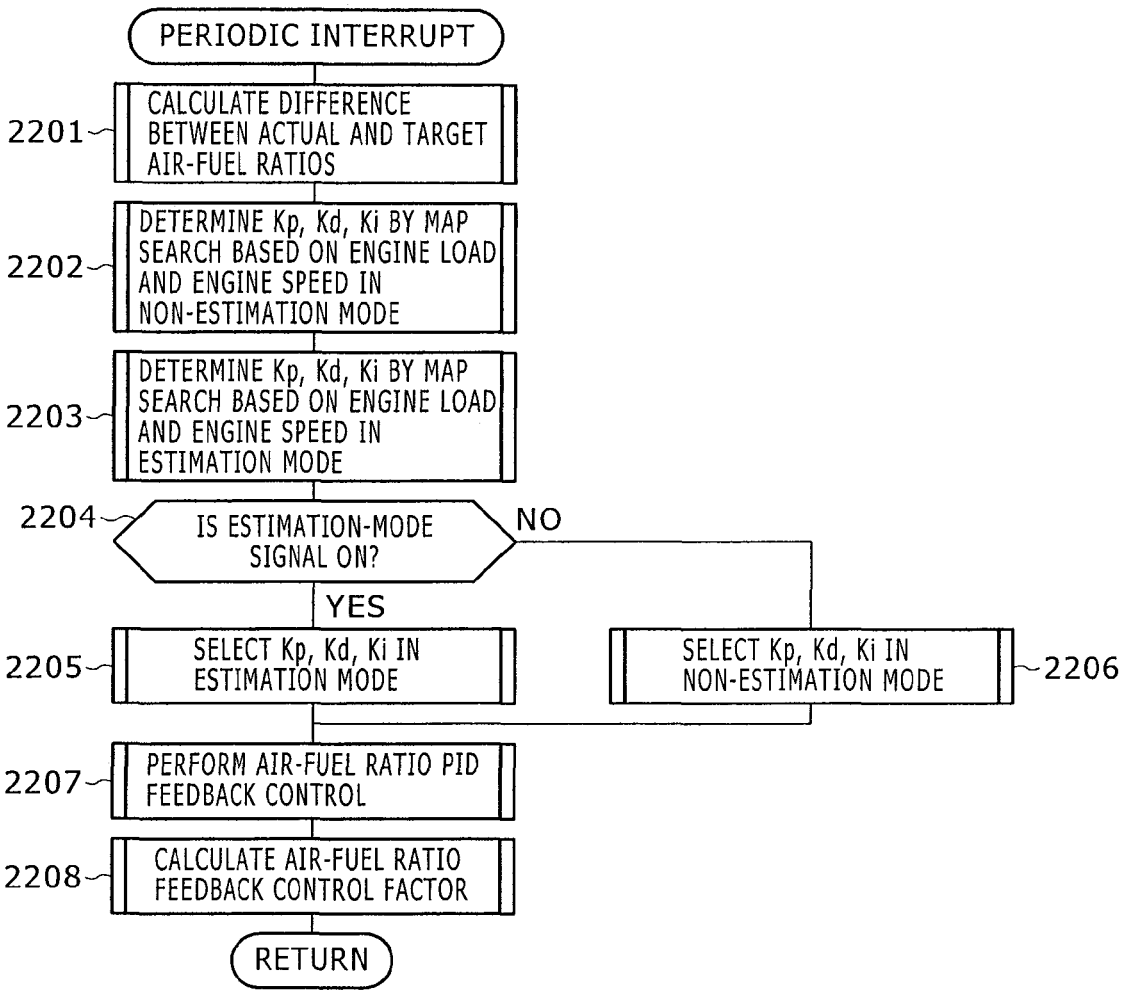
FIG. 22 is a flowchart of an air-fuel ratio PID control routine performed with no air-fuel ratio advance correction performed according to the present embodiment.

FIG. 22 is a flowchart of an air-fuel ratio PID control routine performed with no air-fuel ratio advance correction performed.

In step 2201, the difference between an actual air-fuel ratio and a target air-fuel ratio is calculated. In step 2202, gains Kp, Kd, and Ki of the P, I, and D portions, respectively, of PID control performed when no estimation-mode signal is outputted are determined, by searching a map, based on the engine load and engine speed.

In step 2203, gains Kp, Kd, and Ki of the P, I, and D portions, respectively, of PID control performed when an estimation-mode signal is outputted are determined, by searching a map, based on the engine load and engine speed.

In step 2204, whether an estimation-mode signal is outputted is determined. When it is determined that an estimation-mode signal is outputted, the gains Kp, Kd, and Ki with an estimation-mode signal being outputted are selected in step 2205. When, in step 2204, it is determined that no estimation-mode signal is outputted, the gains Kp, Kd, and Ki with no estimation-mode signal being outputted are selected in step 2206.

In step 2207, air-fuel ratio PID control is performed using the selected gains. In step 2208, an air-fuel ratio feedback control factor is calculated.

Figure 23:
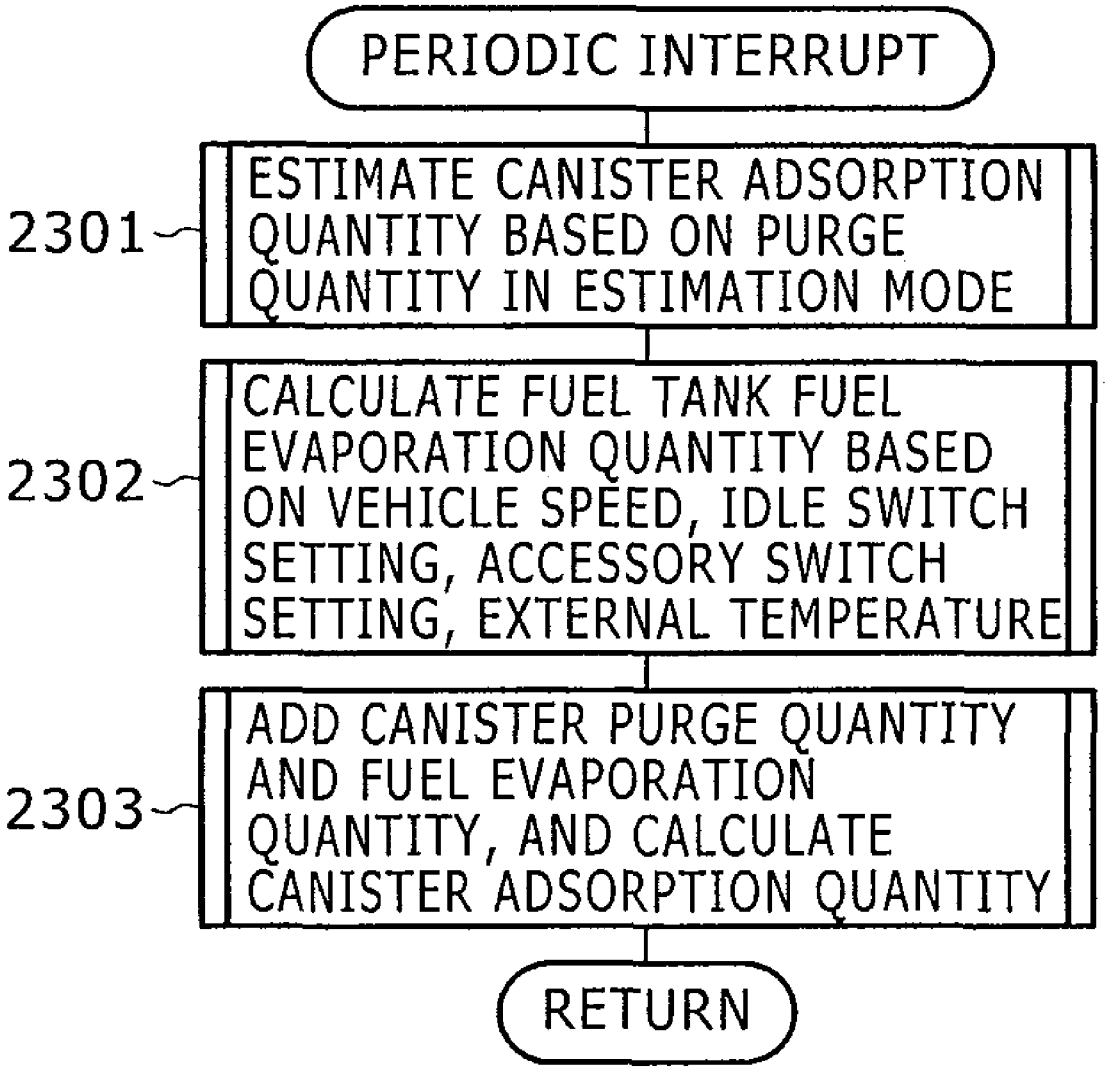
FIG. 23 is a flowchart of a routine performed by the adsorption quantity change calculation section according to the present embodiment.

FIG. 23 is a flowchart of a routine performed by the adsorption quantity change calculation section 408.

In step 2301, a canister adsorption quantity is determined, by searching a table, based on the purge quantity with estimation being performed.

In step 2302, a quantity of fuel evaporating from the fuel tank 220 is calculated based on the vehicle speed, idle switch on/off setting, accessory load switch on/off setting, and external temperature.

In step 2303, the fuel evaporation quantity is added to the canister adsorption quantity CPCSUMHLD to sequentially update the canister adsorption quantity CPCSUMHLD.

Figure 24:
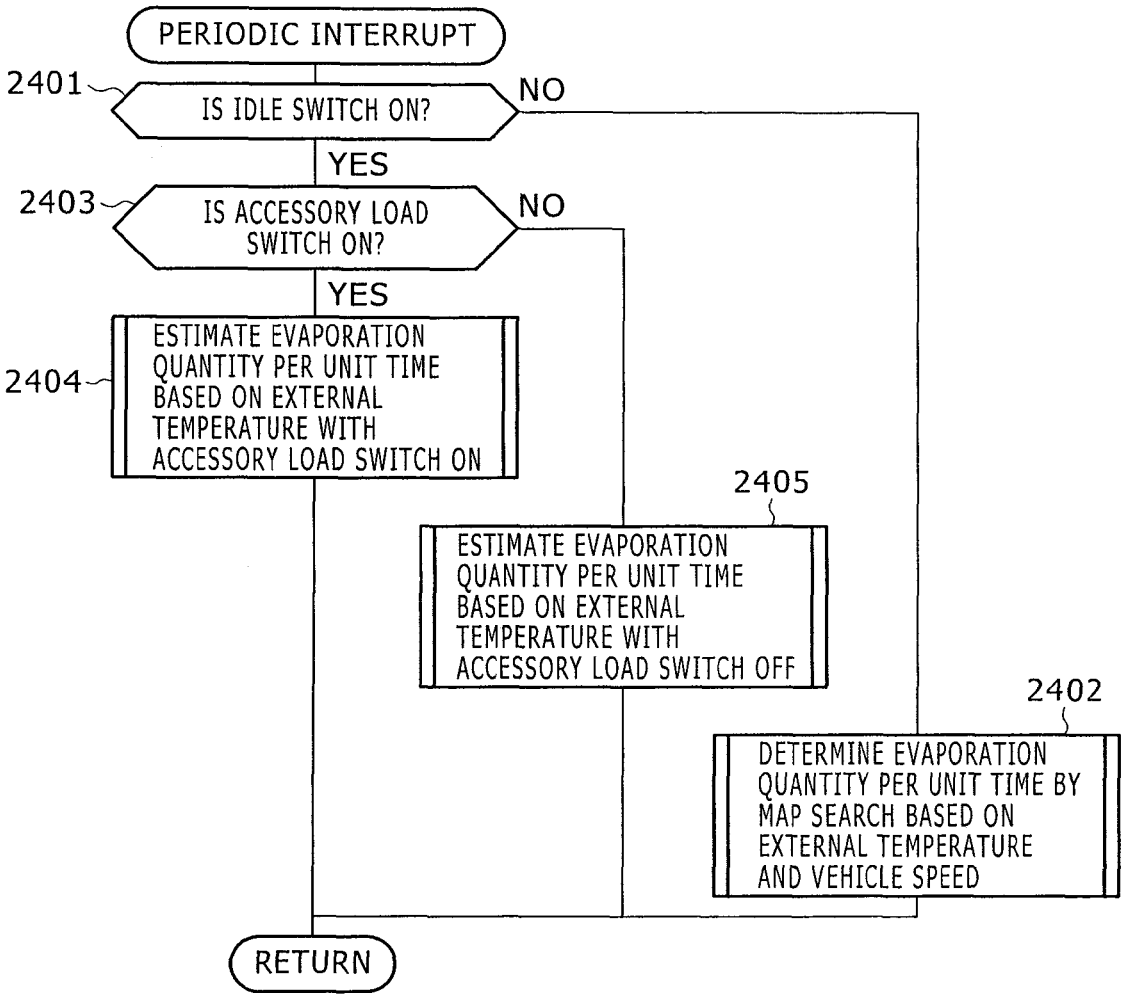
FIG. 24 is a flowchart of a routine performed by the fuel evaporation quantity calculation section according to the present embodiment.

FIG. 24 is a flowchart of a routine performed by the fuel evaporation quantity calculation section 407 to determine the quantity of fuel evaporating from the fuel tank 220.

In step 2401, whether the idle switch is on is determined. When the idle switch is determined to be off, a fuel evaporation quantity per unit time is determined, by searching a map, based on the external temperature and vehicle speed in step 2402.

When the idle switch is determined to be on, whether the accessory load switch is on is determined in step 2403. When the accessory load switch is determined to be on, a fuel evaporation quantity per unit time with the accessory load switch on is determined in step 2402, by searching a table, based on the external temperature. When the accessory load switch is determined to be off, an evaporation quantity per unit time with the accessory load switch off is determined in step 2405, by searching a table, based on the external temperature.

Figure 25A:
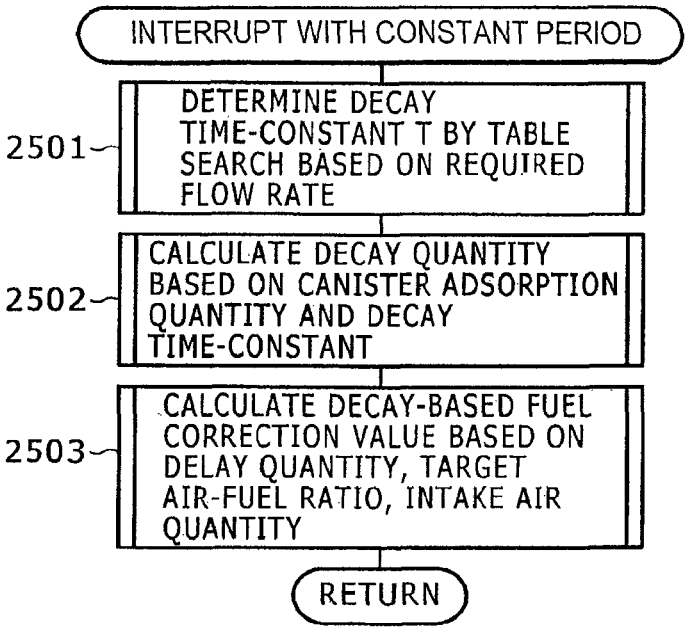
FIGS. 25A and 25B are each a flowchart of a routine performed by the air-fuel ratio correction factor calculation section according to the present embodiment.
Figure 25B:
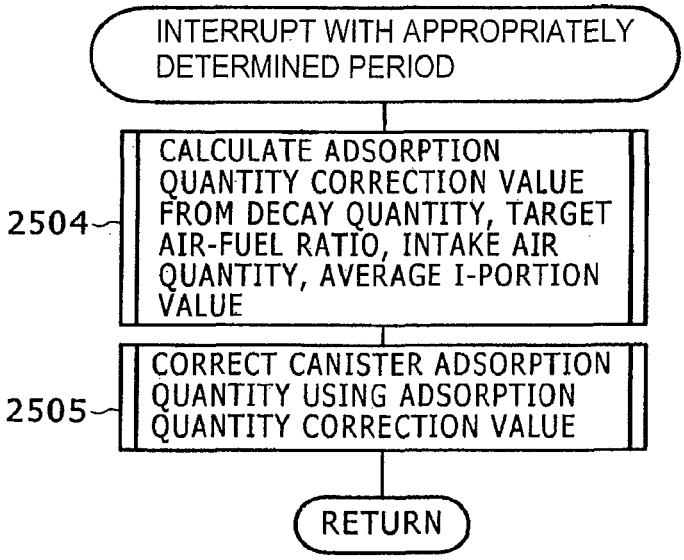

FIGS. 25A and 25B are each a flowchart of a routine performed by the air-fuel ratio correction factor calculation section 409. The flowchart including steps 2501 to 2503 as shown in FIG. 25A represents an interrupt operation performed with a constant period. The flowchart including steps 2504 and 2505 as shown in FIG. 25B represents an interrupt operation performed with an appropriately determined period.

In step 2501, a decay time-constant T is determined, by searching a table, based on the required flow rate. In step 2502, a decay quantity is calculated based on a canister adsorption quantity and the decay time-constant T. In step 2503, a decay-based fuel correction value is calculated based on the decay quantity, a target air-fuel ratio, and an intake air quantity.

In step 2504, a correction value for correcting the canister adsorption quantity is calculated based on the decay quantity, a target air-fuel ratio, an intake air quantity, and an average I-portion value. In step 2505, the canister adsorption quantity is corrected by the correction value.

The engine control device of the present embodiment functions as follows. For the first canister purge performed after the engine is started up, the purge valve is driven for a prescribed period at a prescribed purge flow rate. During the period, the quantity of purged fuel is calculated using an air-fuel ratio feedback factor. Based on the fuel quantity thus calculated, the quantity of evaporative fuel gas adsorbed in the canister 230 is estimated. Thus, when the canister is purged for the first time after a start-up of the engine, evaporative fuel gas is purged for a prescribed period at a prescribed flow rate, and the canister adsorption quantity is estimated based on the quantity of purged evaporative fuel gas, so that a fuel correction factor for the next canister purge can be determined in advance. This makes it possible to reduce variation of the air-fuel ratio during canister purging.

When an adsorption quantity is estimated, the variation of the air-fuel ratio can be reduced by taking into consideration changes in the air-fuel ratio feedback gain and the air-fuel ratio advance correction value. When an adsorption quantity is estimated, it is subsequently corrected repeatedly according to the vehicle condition, namely, based on the difference between the quantities of fuel adsorbed from the fuel tank and purged from the canister and the air-fuel ratio feedback factor. It is, therefore, possible to reduce estimation errors and maintain the accuracy of the fuel correction factor to be applied when the canister is purged.

After the quantity of fuel adsorbed in the canister 230 is estimated, a fuel correction value is calculated based on the estimated adsorption quantity, the quantity of fuel evaporating from the fuel tank 220 is estimated according to the vehicle condition, and the quantity of fuel in the canister is estimated based on the difference between the quantities of fuel charged to and purged from the canister 230. This makes it possible to maintain the accuracy of the fuel correction factor to be applied when the canister is purged.

When the quantity of purged fuel is being calculated, variation of the air-fuel ratio is reduced by applying air-fuel ratio feedback advance correction and changing the air-fuel ratio feedback gain.

What is claimed is:

1. A control device for an internal combustion engine comprising:

an evaporative fuel gas adsorption unit which adsorbs evaporative fuel gas from a fuel tank;

an evaporative fuel gas purging unit which is internally provided with an opening-adjustable purge control valve and which purges evaporative fuel gas adsorbed by the evaporative fuel gas adsorption unit into an intake passage of the internal combustion engine;

a fuel correction unit which feedback controls, based on an air-fuel ratio detected by an air-fuel ratio detection unit, an air-fuel ratio of an air-fuel mixture to be fed to the internal combustion engine to a prescribed value;

a purge control valve opening control unit which performs control to open the purge control valve under a prescribed condition;

a purge quantity calculation unit which, with the purge control valve open under the prescribed condition, calculates a quantity of purged evaporative fuel gas based on a fuel correction value determined by the fuel correction unit engaged in fuel correction calculation for realizing a prescribed air-fuel ratio;

an adsorption quantity estimation unit which determines, based on a quantity of purged evaporative fuel gas calculated by the purge quantity calculation unit, a quantity of evaporative fuel gas adsorbed by the evaporative fuel gas adsorption unit;

an adsorption quantity change calculation unit which changes, according to a condition of the internal combustion engine and vehicle, a quantity of evaporative fuel gas determined by the adsorption quantity estimation unit;

an adsorption quantity correction unit which corrects, according to a condition of the fuel correction unit, a change value calculated by the adsorption quantity change calculation unit; and a fuel correction value calculation unit which calculates a fuel correction value based on an adsorption quantity change calculated by the adsorption quantity change calculation unit.

2. The control device for an internal combustion engine according to claim 1, wherein the fuel correction unit includes:

a target air-fuel ratio setting unit which determines a target air-fuel ratio according to a condition of the internal combustion engine; and an air-fuel ratio feedback control factor calculation unit which calculates an air-fuel ratio feedback control factor for PID control based on a difference between an air-fuel ratio detected by the air-fuel ratio detection unit and a target air-fuel ratio set by the target air-fuel ratio setting unit, and wherein the fuel correction unit changes, under the prescribed condition, a gain of PID control while a quantity of purged evaporative fuel gas is calculated based on a fuel correction value determined thereby.

3. The control device for an internal combustion engine according to claim 1, wherein the fuel correction unit includes:

a target air-fuel ratio setting unit which determines a target air-fuel ratio according to a condition of the internal combustion engine;

an air-fuel ratio feedback control factor calculation unit which calculates an air-fuel ratio feedback control factor for PID control based on a difference between an air-fuel ratio detected by the air-fuel ratio detection unit and a target air-fuel ratio set by the target air-fuel ratio setting unit;

a response delay setting unit which sets a response delay of the air-fuel ratio detection unit; and an air-fuel ratio advance correction value calculation section which calculates, based on a response delay set by the response delay setting unit, a true air-fuel ratio from an air-fuel ratio value detected by the air-fuel ratio detection unit and which determines a fuel correction value based on the calculated true air-furl ratio, and wherein the fuel correction unit performs fuel correction using a fuel correction value determined by the PID control and the air-fuel ratio advance correction value calculation section.

4. The control device for an internal combustion engine according to claim 1, wherein the purge control valve opening control unit includes:

a purge quantity calculation unit which sets a prescribed evaporative fuel gas flow rate under the prescribed condition; and a differential pressure compensation value calculation unit which calculates a differential pressure compensation value from pressures of evaporative fuel gas before and after passing the purge control valve, and wherein the purge control valve opening control unit corrects an opening of the purge control valve according to the differential pressure compensation value so as to achieve the prescribed evaporative fuel gas flow rate.

5. The control device for an internal combustion engine according to claim 1, wherein the adsorption quantity change calculation unit includes a time-constant determination unit for determining a time-constant which decreases according to the evaporative fuel gas flow rate, and wherein the adsorption quantity change calculation unit determines, based on the time-constant determined by the time-constant determination unit, a quantity of evaporative fuel gas evaporating from the fuel tank per unit time and performs calculation to change an adsorption quantity.

6. The control device for an internal combustion engine according to claim 1, wherein the adsorption quantity change calculation unit determines a quantity of evaporative fuel gas evaporating from the fuel tank per unit time according to an intake air temperature, a vehicle speed, idle condition, and accessory load condition, and performs calculation to change an adsorption quantity.

7. The control device for an internal combustion engine according to claim 1, wherein the adsorption quantity change calculation unit holds an adsorption quantity change value representing a change in a quantity of adsorbed evaporative fuel gas at a time when the purge control valve is closed, adds, to the change value thus held, a quantity of evaporative fuel gas coming from the fuel tank according to a condition of the internal combustion engine and vehicle, and, when the purge control valve is opened again, sets a fuel correction value based on an adsorption quantity change, an initial value of which is set to be equal to a value obtained as a result of the addition.

8. The control device for an internal combustion engine according to claim 1, wherein the adsorption quantity estimation unit includes:

a unit which determines a state of a variable of the fuel correction unit for realizing a desired air-fuel ratio from an air-fuel ratio detected, in a state with the purge control valve open, by the air-fuel ratio detection unit; and a unit for determining a certain interval time, and wherein the adsorption quantity estimation unit corrects, every time the interval time elapses, a quantity of adsorbed evaporative fuel gas according to the state of the variable.

9. The control device for an internal combustion engine according to claim 8, wherein the state of a variable of the fuel correction unit for realizing a desired air-fuel ratio from an air-fuel ratio detected by the air-fuel ratio detection unit is an average I-portion value of the air-fuel ratio PID control.

* * * * *